US009358590B2

(12) United States Patent
Koenig et al.

(10) Patent No.: US 9,358,590 B2
(45) Date of Patent: Jun. 7, 2016

(54) ELECTROADHESIVE SURFACE CLEANER

(71) Applicant: SRI International, Menlo Park, CA (US)

(72) Inventors: Karen S. Koenig, San Francisco, CA (US); Harsha Prahlad, Cupertino, CA (US); Ronald E. Pelrine, Longmont, CO (US); Roy D. Kornbluh, Palo Alto, CA (US)

(73) Assignee: SRI International, Menlo Park, CA (US)

( * ) Notice: Subject to any disclaimer, the term of this patent is extended or adjusted under 35 U.S.C. 154(b) by 429 days.

(21) Appl. No.: 13/915,094

(22) Filed: Jun. 11, 2013

(65) Prior Publication Data

US 2013/0276826 A1 Oct. 24, 2013

Related U.S. Application Data

(63) Continuation-in-part of application No. PCT/US2012/030454, filed on Mar. 23, 2012.

(60) Provisional application No. 61/731,185, filed on Nov. 29, 2012, provisional application No. 61/658,335, filed on Jun. 11, 2012, provisional application No. 61/466,907, filed on Mar. 23, 2011.

(51) Int. Cl.
*A47L 13/40* (2006.01)
*B08B 6/00* (2006.01)

(52) U.S. Cl.
CPC .. *B08B 6/00* (2013.01); *A47L 13/40* (2013.01)

(58) Field of Classification Search
None
See application file for complete search history.

(56) References Cited

U.S. PATENT DOCUMENTS 3,536,528 A 10/1970 De Geest
3,684,575 A 8/1972 King (Continued)

FOREIGN PATENT DOCUMENTS

BE 901726 A1 5/1985
DE 202005019251 U1 3/2006

(Continued)

OTHER PUBLICATIONS

International Search Report and Written Opinion for International Application No. PCT/US2012/030454, mailed Oct. 29, 2012, 9 pages.

(Continued)

*Primary Examiner* — Eric Golightly
(74) *Attorney, Agent, or Firm* — McDonnell Boehnen Hulbert & Berghoff LLP

(57) ABSTRACT

An electroadhesive cleaning device or system includes electrode(s) that produce electroadhesive forces from an input voltage to adhere debris against an electroadhesive surface, from which the debris is removed when the forces are controllably modified. Controlling the input voltage may designate the size of debris to be cleaned. A power source provides the input voltage, and the electroadhesive surface can be a continuous track across one or more rollers to move the device across a dirty foreign surface. Electrodes can be arranged in an interdigitated pattern having differing pitches that can be actuated selectively to clean debris of different sizes. Sensors can detect the amount of debris adhered to the electroadhesive surface, and reversed polarity pulses can help repel items away from the electroadhesive surface in a controlled manner.

23 Claims, 26 Drawing Sheets

(56) References Cited

U.S. PATENT DOCUMENTS

| | | | | |
|---|---|---|---|---|
| 4,317,661 | A * | 3/1982 | Sasaoka | B03C 3/12 361/231 |
| 4,962,727 | A | 10/1990 | Harada | |
| 4,996,078 | A | 2/1991 | Langowski | |
| 5,229,170 | A | 7/1993 | Narusawa | |
| 5,378,954 | A | 1/1995 | Higuchi et al. | |
| 6,799,350 | B1 | 10/2004 | Gordon | |
| 7,551,419 | B2 | 6/2009 | Pelrine et al. | |
| 7,554,787 | B2 | 6/2009 | Pelrine et al. | |
| 7,782,591 | B2 | 8/2010 | Cho et al. | |
| 9,186,709 | B2 | 11/2015 | Prahlad et al. | |
| 2004/0163667 | A1 | 8/2004 | Learman | |
| 2005/0059239 | A1 | 3/2005 | Goto | |
| 2005/0126260 | A1 * | 6/2005 | Totoki | B01D 49/00 73/31.02 |
| 2007/0186522 | A1 * | 8/2007 | Hato | A47L 9/1666 55/467 |
| 2008/0089002 | A1 | 4/2008 | Pelrine et al. | |
| 2010/0154821 | A1 | 6/2010 | Moriya et al. | |
| 2010/0218467 | A1 * | 9/2010 | Witter | B01D 45/12 55/337 |
| 2010/0307342 | A1 | 12/2010 | Gibis et al. | |
| 2012/0061903 | A1 | 3/2012 | Eguchi et al. | |
| 2013/0276826 | A1 | 10/2013 | Koenig et al. | |
| 2014/0064905 | A1 | 3/2014 | Prahlad et al. | |
| 2014/0104744 | A1 | 4/2014 | Prahlad et al. | |
| 2014/0133062 | A1 | 5/2014 | Prahlad et al. | |

FOREIGN PATENT DOCUMENTS

| | | | | |
|---|---|---|---|---|
| DE | 102008008576 | A1 | 8/2009 | |
| EP | 0401489 | | 12/1990 | |
| EP | 1852192 | A2 | 7/2007 | |
| EP | 1974644 | A2 | 10/2008 | |
| EP | 1985432 | | 10/2008 | |
| JP | S61-71433 | U | 5/1986 | |
| JP | H5-285084 | A | 2/1993 | |
| JP | 9-90751 | | 4/1997 | |
| JP | H9-131290 | A | 5/1997 | |
| JP | 11-056731 | | 3/1999 | |
| JP | 2001-269301 | | 10/2001 | |
| JP | 2003-225625 | A | 8/2003 | |
| JP | 2009-226310 | A | 10/2009 | |
| JP | 2012-056745 | | 3/2012 | |
| KR | 2010-0025814 | | 3/2010 | |
| WO | 2005/117679 | A1 | 12/2005 | |
| WO | 2007/143662 | A2 | 12/2007 | |
| WO | WO 2008070201 | A2 * | 6/2008 | H02N 13/00 |
| WO | 2009/100744 | A1 | 8/2009 | |
| WO | 2012/129541 | A2 | 9/2012 | |

OTHER PUBLICATIONS

International Search Report and Written Opinion for International Application No. PCT/US/2013/045200, mailed Oct. 2, 2013, 8 pages.

Notification of Reason(s) for Rejection, Japanese Patent Application No. 2014-501289, dated Nov. 20, 2014.

European Search Report, European Patent Application No. 12761130, dated Sep. 9, 2014.

* cited by examiner

ELECTROADHESIVE SURFACE CLEANER

CROSS REFERENCE TO RELATED APPLICATION

The present application is a continuation-in-part of Patent Cooperation Treaty application PCT/US12/30454, filed Mar. 23, 2012, which claims priority to U.S. provisional application Ser. No. 61/466,907, filed Mar. 23, 2011. The present application also claims priority to U.S. provisional application Ser. No. 61/731,185, filed Nov. 29, 2012, and U.S. provisional application Ser. No. 61/658,335, filed on Jun. 11, 2012. All priority applications are herein incorporated by reference as if fully set forth in this description.

BACKGROUND

Cleaning devices such as wipes, sponges, brushes, brooms, mops, dusters, vacuum cleaners and the like are generally well known and widely used to clean floors and surfaces in all sorts of home, commercial and industrial environments. Such devices can be used to clean in both indoor and outdoor settings, with further traditionally outdoor devices such as rakes, mowers, blowers and the like having various applications across numerous other settings as well. Many of these devices and tools require a significant amount of manual labor to be useful, such that a wide variety powered implementations, features and other improvements have been provided for many such cleaning devices over the years to help users in this regard.

SUMMARY

The present disclosure describes embodiments that relate to an electroadhesive surface cleaner. In one aspect, a device is described. The device comprises at least one electroadhesive surface positioned at or proximate to one or more electrodes and configured to interact with debris on a surface to be cleaned. The device also comprises a power supply configured to apply an input voltage to the one or more electrodes to thereby cause at least a portion of the debris to adhere to the electroadhesive surface. The at least one electroadhesive surface is configured to move, with the portion of the debris adhered thereto, away from the surface to be cleaned so as to remove the portion of the debris from the surface to be cleaned.

In another aspect, a system is described. The system comprises at least one electroadhesive surface positioned at or proximate to one or more electrodes and configured to interact with debris on a surface to be cleaned. The system also comprises a power supply configured to apply an input voltage to the one or more electrodes to thereby cause at least a portion of the debris to adhere to the electroadhesive surface. The at least one electroadhesive surface is configured to move, with the portion of the debris adhered thereto, away from the surface to be cleaned so as to remove the portion of the debris from the surface to be cleaned. The system further comprises a removal component configured to facilitate removal of the portion of the debris adhered to the electroadhesive surface after the portion has been removed from the surface to be cleaned.

In still another aspect, a method is described. The method comprises moving an electroadhesive surface over debris on a surface to be cleaned. The method also comprises applying, by a power supply, a voltage to one or more electrodes located at or proximate to the electroadhesive surface. The voltage causes at least a portion of the debris to adhere to the electroadhesive surface. The method further comprises moving the electroadhesive surface, with the portion of the debris adhered thereto, away from the surface to be cleaned so as to remove the portion of the debris from the surface to be cleaned. The method also comprises, after the electroadhesive surface has moved away from the surface to be cleaned, removing the portion of the debris from the electroadhesive surface.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1A:
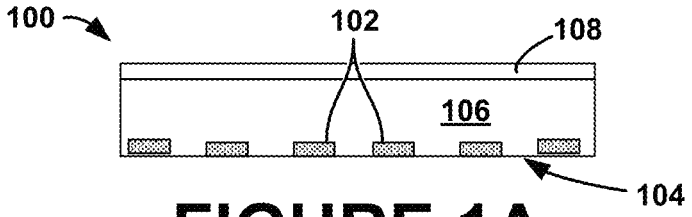
FIG. 1A illustrates an electroadhesive device in side cross-sectional view, in accordance with an example embodiment.

The following detailed description describes various features and functions of the disclosed systems and methods with reference to the accompanying figures. In the figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

The present disclosure describes various embodiments to devices, systems and methods involving active electrostatic cleaning applications. In various examples, the subject cleaning devices, systems or methods can utilize an active electroadhesion component that includes a power source and one or more electrodes that are arranged to generate specific and controllable electroadhesive forces with respect to one or more particles, debris, or other foreign objects to be cleaned. The term "active" generally refers to a controlled, power source based, and/or more powerful/higher charge application of electroadhesion and electrostatic principles, in contrast with the generally uncontrolled and typically low charge nature of electrostatic cling that is inherently generated by and featured in traditional electrostatic dusters and other similar items.

While the various examples disclosed herein focus on particular aspects of specific electroadhesive applications, it will be understood that the various principles and examples disclosed herein can be applied to other electrostatic applications and arrangements as well. For example, an electrolaminate application involving one or more electrostatically charged sheets can utilize the same types of electrodes and general electrostatic principles for cleaning and otherwise controlling particles, debris, and other foreign objects. Furthermore, while the particular applications described herein are made with respect to cleaning or handling particles and other items by way of electroadhesive forces, the various electrodes and materials therefore provided herein can be used in a variety of other applications that are not restricted to such environments.

As the term is used herein, "electroadhesion" refers to the mechanical coupling of two objects using electrostatic forces. Electroadhesion as described herein uses electrical control of these electrostatic forces to permit temporary and detachable attachment between two objects. This electrostatic adhesion holds two surfaces of these objects together or increases the traction or friction between two surfaces due to electrostatic forces created by an applied electrical field. Although electrostatic clamping has traditionally been limited to holding two flat, smooth and generally conductive surfaces separated by a highly insulating material together, the various examples provided herein can involve electroadhesion devices and techniques that do not limit the material properties, curvatures, size or surface roughness of the objects subject to electroadhesive forces and handling. Furthermore, while the various examples and discussions provided herein typically involve electrostatically adhering a particle, debris, or other foreign item to a cleaning device, it will also be understood that many other types of electrostatic applications may also generally be implicated for use with the disclosed examples. For example, two components of the same device may be electrostatically adhered to each other, such as in an electrolaminate or other type of arrangement.

I. Overview

Controlled use of active electroadhesion can facilitate improved cleaning for such devices and methods. An electroadhesive cleaning device or system can be adapted to clean debris, or move one or more foreign objects, away from a surface to be cleaned. The device or system can include one or more electrodes adapted to produce one or more electroadhesive forces from an input voltage, one or more input components configured to accept and facilitate user input to control the input voltage, and at least one interactive electroadhesive surface positioned proximate and/or distal to the electrode(s) and configured to interact with one or more foreign objects to be cleaned.

A separate respective electroadhesive force can be generated for each foreign object to be cleaned, and each such electroadhesive force can suitably adhere its respective foreign object to the electroadhesive surface or elsewhere on the cleaning device. The electroadhesive surface or surfaces can be arranged to permit the passage of the electroadhesive force(s) therethrough, such that the foreign object(s) are adhered thereagainst. In addition, the electroadhesive surface(s) can be further configured to facilitate the ready removal of the foreign object(s) therefrom, such as when the electroadhesive force(s) are controllably altered. Such altering can be a reduction, removal or reversal of the electroadhesive force(s). The foreign object(s) can also be physically removed without necessarily altering the electroadhesive force(s), such as by using mechanical forces such as those provided by a dust brush in contact with the electroadhesive surface(s), a non-contact electrostatic plate that attracts dust away from the electroadhesive surface onto itself, a fluid jet that washes or blows away items, or a localized vacuum that pulls dust away from the electroadhesive surface, for example.

In examples, the foreign object(s) can include debris such as dust, dirt, pebbles, crumbs, hair, garbage and/or other particulate matter to be cleaned. In some examples, the electroadhesive surface can include a plurality of cilia, a plurality of flaps, one or more light adhesives, and/or any of a variety of materials, such as soft, tacky, fabric, fiber, cloth, plastic and/or other suitable materials. In some examples, at least a portion of the electroadhesive surface can comprise a deformable (or compliant) surface, such that a respective portion of the deformable surface moves closer to (i.e., comply with a shape of) at least one of the foreign objects when the electroadhesive force is applied.

In examples, the electroadhesive cleaning device or system can include an active power source coupled to one or more input components and one or more electrodes, where the active power source is configured to facilitate providing the input voltage to the one or more electrodes. In addition, in some examples, the device may include one or more rollers coupled to the electroadhesive surface and configured to rotate the electroadhesive surface with respect to a foreign surface such that a new, clean portion of the electroadhesive surface is controllably presented to the remaining foreign objects or debris regardless of motion of the electroadhesive cleaning device as a whole. In such arrangements, the electroadhesive surface(s) can be configured as a continuous track that moves with respect to a rotational motion of the one or more rollers.

In some examples, a removal component or components can be configured to facilitate the removal of the one or more foreign objects from the electroadhesive surface after the one or more foreign objects have been displaced from the surface to be cleaned. For such a removal component, for example, the electrode(s) can be further adapted to produce collectively one or more reverse polarity pulses, such that one or more repellant forces suitably repel one or more foreign objects or debris away from the active electroadhesive cleaning device when the charges are controllable reversed.

In examples, the electrodes can include a plurality of oppositely chargeable electrodes arranged into a pattern. Such a pattern can involve an interdigitated pattern or portion having a plurality of differing pitches. Such differing pitches can be configured to clean foreign objects or debris of correspondingly different sizes, and the interdigitated electrode pattern may be configured to actuate the plurality of differing pitches selectively. In this manner, the size of the foreign objects to be cleaned can be designated, such as by a user input. In some examples, one or more sensors can be coupled to the electroadhesive surface and configured to detect the amount of foreign objects or debris adhered thereto. Such sensors can be used to aid in the removal of particular matter from the electroadhesive surface in some cases. Alternatively, or in addition, such sensors can indicate to the user that it is time for thorough cleaning or replacement of the electroadhesive surface(s).

In still further examples, the device or system can include an ion charge sprayer positioned proximate the electroadhesive surface and adapted to spray a plurality of ionic charges onto the foreign object(s), such that at least a portion of the respective electroadhesive force(s) result from the presence of the ionic charges on the foreign object(s). In such examples, exactly one electrode can be used, with that exactly one electrode being adapted to carry a charge of the opposite polarity from the plurality of ionic charges.

In other examples, various methods of physically cleaning the debris or the one or more foreign objects are provided. Such methods can involve cleaning a plurality of foreign objects or debris away from a surface to be cleaned, for example. Process steps can include contacting an electroadhesive surface to each of a plurality of foreign objects situated about the surface to be cleaned, applying an electrostatic adhesion voltage in a controlled manner across one or more electrodes located proximate the electroadhesive surface, adhering each of the plurality of foreign objects to the electroadhesive surface via respective electrostatic attraction forces, moving the electroadhesive surface away from the surface to be cleaned while the plurality of foreign objects remain adhered thereto, altering the electrostatic adhesion voltage in a controlled manner, and removing the plurality of foreign objects from the electroadhesive surface after the electrostatic adhesion voltage has been altered. Similar to the foregoing, the electrostatic adhesion voltage can be sufficient to generate a separate respective electrostatic attraction force through at least a portion of the electroadhesive surface with respect to each of the plurality of foreign objects situated about the surface to be cleaned. In some examples, the surface to be cleaned can be the ground, floor, a vertical surface such as a wall or another other relevant surface to be cleaned. In some examples, the step of altering the electrostatic adhesion voltage can include reversing the polarity of the voltage. Such a feature can result in repelling the foreign object(s) away from the electroadhesive surface in a controlled manner at a desired time. In examples, in addition or alternative to modifying the voltage, electrostatic adhesion can be altered by mechanically moving a portion of the electroadhesive surface away from or off of the electrodes in order to remove the foreign objects from the electroadhesive surface.

Other apparatuses, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

Referring now to the Figures, FIG. 1A illustrates an electroadhesive device in elevated cross-sectional view, in accordance with an example embodiment. Electroadhesive device 100 includes one or more electrodes 102 located at or near an electroadhesive gripping surface 104 thereof, as well as an insulating material 106 between electrodes 102 and a backing 108 or other supporting structural component. For purposes of illustration, electroadhesive device 100 is shown as having six electrodes in three pairs; however, more or fewer electrodes can be used in a given electroadhesive device. Where a single electrode is used in a given electroadhesive device, a complimentary electroadhesive device having at least one electrode of the opposite polarity can be used therewith. With respect to size, electroadhesive device 100 is substantially scale invariant. That is, electroadhesive device sizes may range from less than 1 square centimeter to greater than several meters in surface area, for example. Larger and smaller surface areas also possible, and may be sized based on a given application.

Although electroadhesive device 100 having electroadhesive gripping surface 104 of FIG. 1A is shown as having six electrodes 102, it will be understood that a given electroadhesive device or gripping surface can have a single electrode. Furthermore, a given electroadhesive device can have a plurality of different electroadhesive gripping surfaces, with each separate electroadhesive gripping surface having at least one electrode and being configured to be placed against or in close proximity to the foreign object to be gripped. Although the terms electroadhesive device, electroadhesive gripping unit and electroadhesive gripping surface are all used herein to designate electroadhesive components of interest, these various terms can be used interchangeably in various contexts. In particular, while a given electroadhesive device might comprise numerous distinct "gripping surfaces," these different gripping surfaces might themselves also be considered separate "devices" or alternatively "end effectors."

Figure 1B:
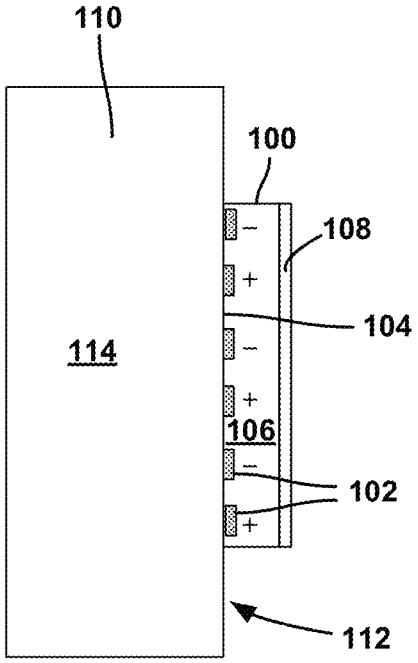
FIG. 1B illustrates the electroadhesive device of FIG. 1A adhered to a foreign object in side cross-sectional view, in accordance with an example embodiment.

FIG. 1B depicts in elevated cross-sectional view the electroadhesive device 100 of FIG. 1A adhered to a foreign object 110, in accordance with an example embodiment. Foreign object 110 includes surface 112 and inner material 114. Electroadhesive gripping surface 104 of electroadhesive device 100 is placed against or nearby surface 112 of foreign object 110. An electrostatic adhesion voltage is then applied via electrodes 102 using external control electronics (not shown) in electrical communication with the electrodes 102. As shown in FIG. 1B, the electrostatic adhesion voltage may comprise alternating positive and negative charges on neighboring electrodes 102. As result of the voltage difference between electrodes 102, one or more electroadhesive forces are generated, which electroadhesive forces act to hold the electroadhesive device 100 and foreign object 110 to each other. Due to the nature of the forces being applied, electroadhesive device 100 may be adhered to foreign object 110 without actual contact. For example, a piece of paper, thin film, or other material or substrate may be placed between electroadhesive device 100 and foreign object 110. Furthermore, although the term "contact" is used herein to denote the interaction between an electroadhesive device and a foreign object, direct surface to surface contact is not always required, such that one or more thin objects such as an insulator, can be disposed between an electroadhesive gripping surface and the foreign object. In some examples such an insulator between the gripping surface and foreign object can be a part of the device, while in others it can be a separate item or device.

Figure 1C:
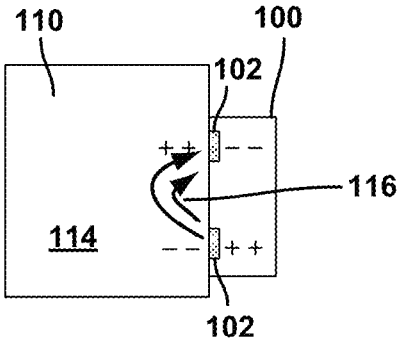
FIG. 1C illustrates close-up side cross-sectional view an electric field formed in the foreign object of FIG. 1B as result of the voltage difference between electrodes in the adhered electroadhesive device, in accordance with an example embodiment.

FIG. 1C illustrates in elevated cross-sectional close-up view an electric field formed in the foreign object 110 of FIG. 1B as a result of the voltage difference between electrodes in the adhered electroadhesive device 100, in accordance with an example embodiment. While the electroadhesive device 100 is placed against foreign object 110 and an electrostatic adhesion voltage is applied, an electric field 116 forms in the inner material 114 of the foreign object 110. The electric field 116 locally polarizes inner material 114 or induces direct charges on material locally opposite to the charge on the electrodes 102 of the device, and thus causes electrostatic adhesion between the electrodes 102 (and overall device 100) and the induced charges on the foreign object 110. The induced charges may be the result of a dielectric polarization or from weakly conductive materials and electrostatic induction of charge. In the event that the inner material 114 is a strong conductor, such as copper for example, the induced charges may completely cancel the electric field 116. In this case the internal electric field 116 may be zero, but the induced charges nonetheless still form and provide electrostatic force to the device 100. An insulator may also be provided between the device 100 and foreign object 110 in instances where material 114 is copper or another strong conductor.

Thus, the electrostatic adhesion voltage provides an overall electrostatic force, between the electroadhesive device 100 and inner material 114 beneath surface 112 of foreign object 110, which electrostatic force maintains the current position of the electroadhesive device 100 relative to the surface of the foreign object 110. The overall electrostatic force may be sufficient to overcome the gravitational pull on the foreign object 110, such that the electroadhesive device 100 may be used to hold the foreign object 110 aloft. In examples, a plurality of electroadhesive devices may be placed against foreign object 110, such that additional electrostatic forces against the object can be provided. Furthermore, the foreign object 110 may not be larger than the electroadhesive device 100 in all or any dimension, and it is contemplated that the foreign object 110 can be significantly smaller than the electroadhesive device in some examples. The combination of electrostatic forces may be sufficient to lift, move, pick and place, or otherwise handle the foreign object 110. Electroadhesive device 100 may also be attached to other structures and hold these additional structures aloft, or it may be used on sloped or slippery surfaces to increase normal friction forces.

Removal of the electrostatic adhesion voltages from electrodes 102 ceases the electrostatic adhesion force between electroadhesive device 100 and the surface 112 of foreign object 110. Thus, when there is no electrostatic adhesion voltage between electrodes 102, electroadhesive device 100 can move more readily relative to surface 112. This condition allows the electroadhesive device 100 to move before and after an electrostatic adhesion voltage is applied. Well controlled electrical activation and de-activation enables fast adhesion and detachment, such as response times less than about 50 milliseconds, for example, while consuming relatively small amounts of power. Larger release times may also be valuable in many applications.

Electroadhesive device 100 includes electrodes 102 on an outside surface 104 of an insulating material 106. This example may be well suited for controlled attachment to insulating and weakly conductive inner materials 114 of various foreign objects 110. Other electroadhesive device 100 relationships between electrodes 102 and insulating materials 106 are also contemplated and suitable for use with a broader range of materials, including conductive materials. For example, a thin electrically insulating material (not shown) can be located on the surfaces of the electrodes where surface 112 is on a metallic object. A shorter distance between surfaces 104 and 112 results in a stronger electroadhesive force between the objects. Accordingly, a deformable surface 104 configured to at least partially conform to the surface 112 of the foreign object 110 can be used.

As the term is used herein, an electrostatic adhesion voltage refers to a voltage that produces a suitable electrostatic force to couple electroadhesive device 100 to a foreign object 110. The minimum voltage needed for electroadhesive device 100 will vary with a number of factors, such as: the size of electroadhesive device 100, the material conductivity and spacing of electrodes 102, the insulating material 106, the size of the foreign object 110, the foreign object material 114, the presence of any disturbances to electroadhesion such as dust, other particulates or moisture, the weight of any objects being supported by the electroadhesive force, compliance of the electroadhesive device, the dielectric and resistivity properties of the foreign object, and the relevant gaps between electrodes and foreign object surface. In one example, the electrostatic adhesion voltage includes a differential voltage between the electrodes 102 that is between about 500 volts and about 15 kilovolts. Even lower voltages may be used in micro applications. In another example, the differential voltage is between about 2 kilovolts and about 5 kilovolts. Voltage for one electrode can be zero. Alternating positive and negative charges may also be applied to adjacent electrodes 102. The voltage on a single electrode may be varied in time, and in particular may be alternated between positive and negative charge so as to not develop substantial long-term charging of the foreign object. The resultant forces will vary with the specifics of a particular electroadhesive device 100, the material it adheres to, any particulate disturbances, surface roughness, and so forth. In general, electroadhesion as described herein provides a wide range of clamping pressures, generally defined as the attractive force applied by the electroadhesive device divided by the area thereof in contact with the foreign object.

Figure 1D:
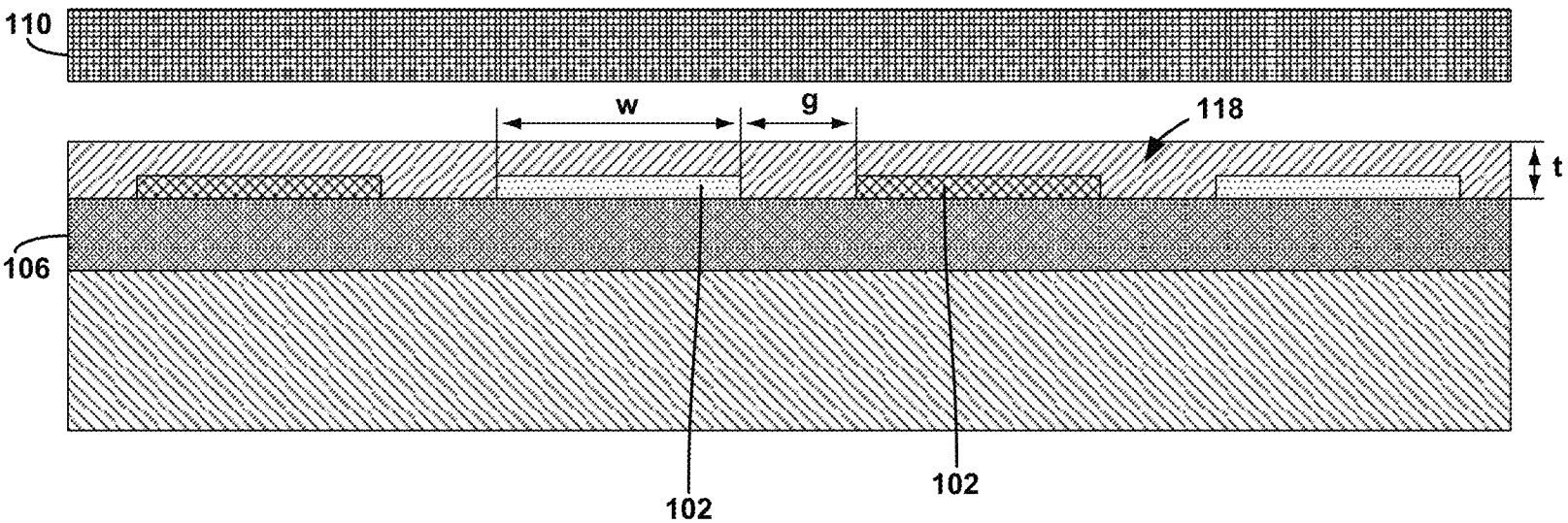
FIG. 1D illustrates design parameters of an electroadhesive device, in accordance with an example embodiment.

FIG. 1D illustrates design parameters of an electroadhesive device, in accordance with an example embodiment. The electroadhesive device in FIG. 1D includes foreign object 110 (a substrate to attach to, or dirt to pick up), insulating material 106, electrodes 102, backing material 108 (structure for load transfer through foam to rigid surface, for example), and a dielectric coating material 118. Electroadhesion design parameters shown in FIG. 1D can be modified to affect type and range of materials to be picked up or adhered to an electroadhesive surface. The parameters include properties of insulator material 106, properties of dielectric coating material 118, compliance and stiffness of the materials used, properties of electrode(s) 102, thickness of the dielectric coating (t), width of electrodes (w), gap between successive electrodes (g), and the voltage applied to the electrodes including magnitude and waveform. These are example properties, and other properties can also affect performance of an electroadhesive device such as the electroadhesive device 100.

The actual electroadhesion forces and pressure will vary with design and a number of factors. In an example, electroadhesive device 100 provides electroadhesive attraction pressures between about 0.7 kPa (about 0.1 psi) and about 70 kPa (about 10 psi); however, other amounts and ranges are also possible. The amount of force needed for a particular application may be readily achieved by varying the area of the contacting surfaces, varying the applied voltage, and/or varying the distance between the electrodes and foreign object surface, although other relevant factors may also be manipulated as desired.

In examples, having as much of the surface as possible covered with electrodes (i.e. minimize "g" and maximize "w") may improve clamping on "conductive" materials (metal, some kinds of wood, paper, etc.). Some conductive particles (rice, leaves, cereal etc.) may also fall in this category. However, non-conductive materials (such as some kinds of glass, almost all plastics, sand etc.) may respond to a different type of electrostatic charging which is maximized by increasing the number of electrode lines in a given area (i.e. minimize both "g" and "w"). Therefore, forces can be optimized through careful choice of "w" and "g." Generally, optimization of "w," "g", and "t" for a given surface may improve electroadhesion performance related to that surface.

Figure 2A:
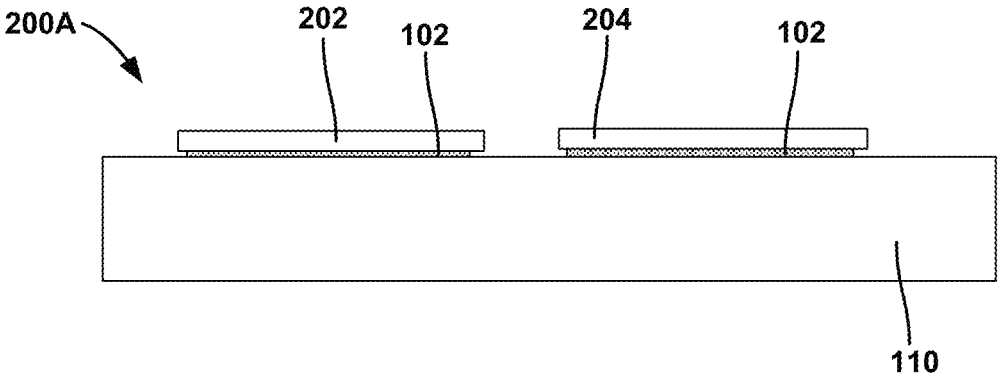
FIG. 2A illustrates in side cross-sectional view a pair of electroadhesive surfaces or devices having single electrodes thereon, in accordance with example embodiments.
Figure 2B:
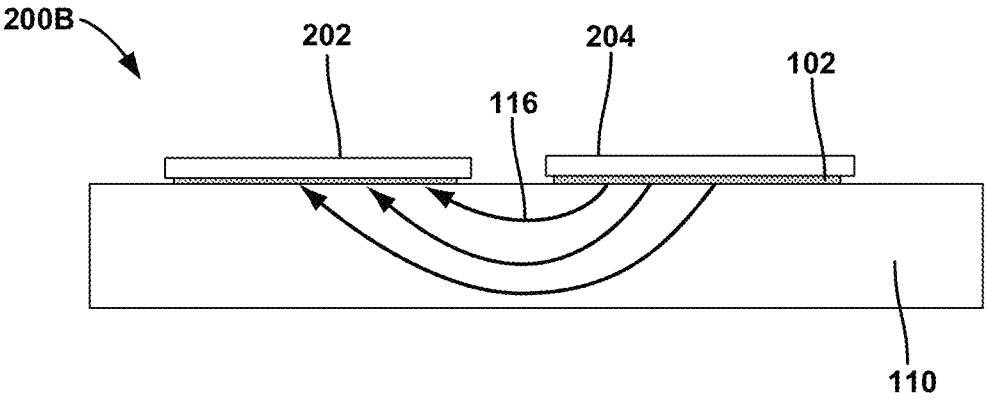
FIG. 2B illustrates in side cross-sectional view the pair of electroadhesive surfaces or devices of FIG. 2A with voltage applied thereto, in accordance with example embodiments.

Referring to FIGS. 2A and 2B, a pair of electroadhesive devices or gripping surfaces having single electrodes thereon is shown in side cross-sectional view, in accordance with an example embodiment. FIG. 2A depicts electroadhesive gripping system 200A having electroadhesive devices or gripping surfaces 202 and 204 that are in contact with the surface of a foreign object 110, while FIG. 2B depicts activated electroadhesive gripping system 200B with the devices or gripping surfaces having voltage applied thereto. Electroadhesive gripping system 200A includes two electroadhesive devices or gripping surfaces 202 and 204 that directly contact the foreign object 110. Each electroadhesive device or gripping surface 202 and 204 has a single electrode 102 coupled thereto. In such cases, the electroadhesive gripping system can be designed to use the foreign object as an insulation material. When voltage is applied, an electric field 116 forms within foreign object 110, and an electrostatic force between the electroadhesive devices or gripping surfaces 202 and 204 and the foreign object 110 is created. Other examples that include numerous of these single electrode electroadhesive devices are also possible.

In some examples, an electroadhesive gripping surface can take the form of a flat panel or sheet having a plurality of electrodes thereon. In other examples, the gripping surface can take a fixed shape that is matched to the geometry of the foreign object most commonly lifted or handled. For example, a curved geometry can be used to match the geometry of a cylindrical paint can or soda can. The electrodes may be enhanced by various means, such as by being patterned on an adhesive device surface to improve electroadhesive performance, or by making them using soft or flexible materials to increase compliance and thus conformance to irregular surfaces on foreign objects.

Figure 3A:
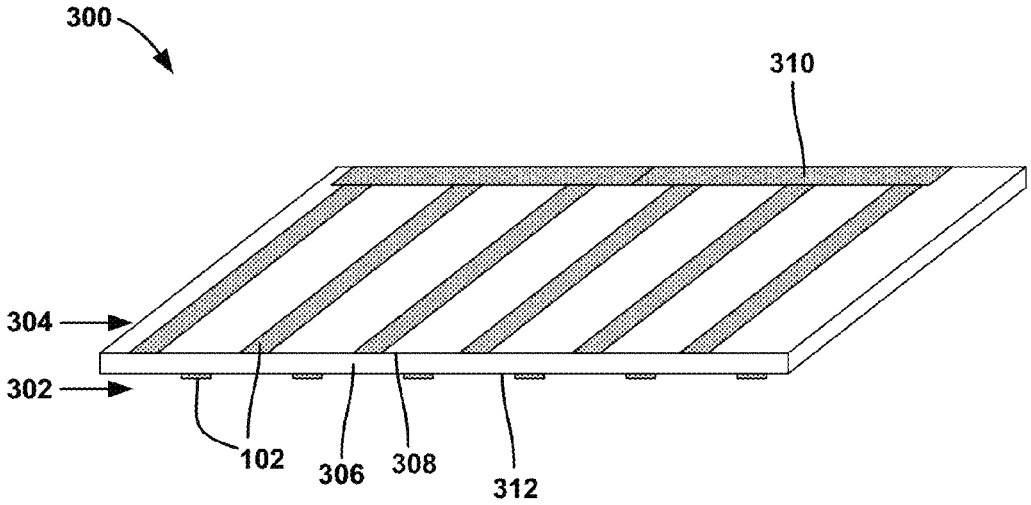
FIG. 3A illustrates in top perspective view an electroadhesive surface in the form of a sheet with electrodes patterned on top and bottom surfaces thereof, in accordance with an example embodiment.
Figure 3B:
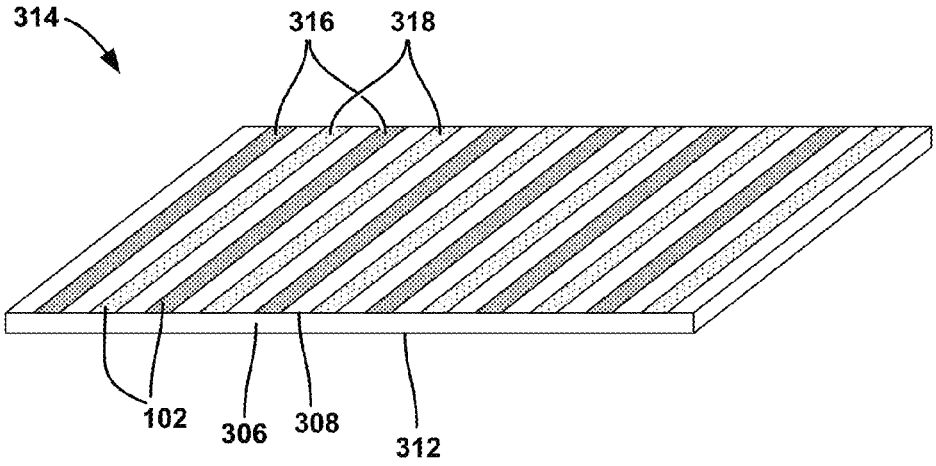
FIG. 3B illustrates in top perspective view an alternative electroadhesive surface in the form of a sheet with electrodes patterned on a single surface thereof, in accordance with an example embodiment.

FIGS. 3A and 3B illustrate two examples of electroadhesive gripping surfaces in the form of flat panels or sheets with electrodes patterned on surfaces thereof shown in top perspective view, in accordance with example embodiments. FIG. 3A shows electroadhesive gripping surface 300 in the form of a sheet or flat panel with electrodes 102 patterned on top and bottom surfaces thereof. Bottom and top electrodes sets 302 and 304 are interdigitated on opposite sides of an insulating layer 306. In some examples, insulating layer 306 can be formed of a stiff or rigid material. In examples, the electrodes as well as the insulating layer 306 may be compliant and composed of a polymer, such as an acrylic elastomer, to increase compliance. As an example for illustration, the modulus of the polymer is below about 10 MPa; and in another example, the modulus is more specifically below about 1 MPa. Various types of compliant electrodes suitable for use are generally known, and examples are described in commonly owned U.S. Pat. No. 7,034,432, which is incorporated by reference herein in its entirety and for all purposes.

Electrode set 304 is disposed on a top surface 308 of insulating layer 306, and includes an array of linear patterned electrodes 102. A common electrode 310 electrically couples electrodes 102 in set 304 and permits electrical communication with all the electrodes 102 in set 304 using a single input lead to common electrode 310. Electrode set 302 is disposed on a bottom surface 312 of insulating layer 306, and includes a second array of linear patterned electrodes 102 that is laterally displaced from electrodes 102 on the top surface. Bottom electrode set 302 may also include a common electrode (not shown). Electrodes can be patterned on opposite sides of an insulating layer 306 to increase the ability of the electroadhesive gripping surface (end effector) 300 to withstand higher voltage differences without being limited by breakdown in the air gap between the electrodes.

Additionally or alternatively, electrodes may also be patterned on the same surface of the insulating layer, as shown in FIG. 3B. As shown, electroadhesive gripping surface 314 comprises a sheet or flat panel with electrodes 102 patterned on one surface thereof. Electroadhesive gripping surface 314 can be substantially similar to electroadhesive gripping surface 300 of FIG. 3A, except that electrodes sets 316 and 318 are interdigitated on the same surface 308 of a compliant insulating layer 306. No electrodes are located on the bottom surface 312 of insulating layer 306. This particular example shows decreasing the distance between the positive electrodes 102 in set 316 and negative electrodes 102 in set 318, and illustrates placement of both sets of electrodes on the same surface of electroadhesive gripping surface 314. Functionally, this eliminates the spacing between the electrodes sets 316 and 318 due to insulating layer 306. It also eliminates the gap between one set of electrodes (previously on bottom surface 312) and the foreign object surface when the top surface 308 adheres to the foreign object surface. Although either embodiment 300 or 314 can be used, these changes in the latter embodiment 314 may increase the electroadhesive forces between electroadhesive gripping surface 314 and the subject foreign object to be handled.

Figure 4A:
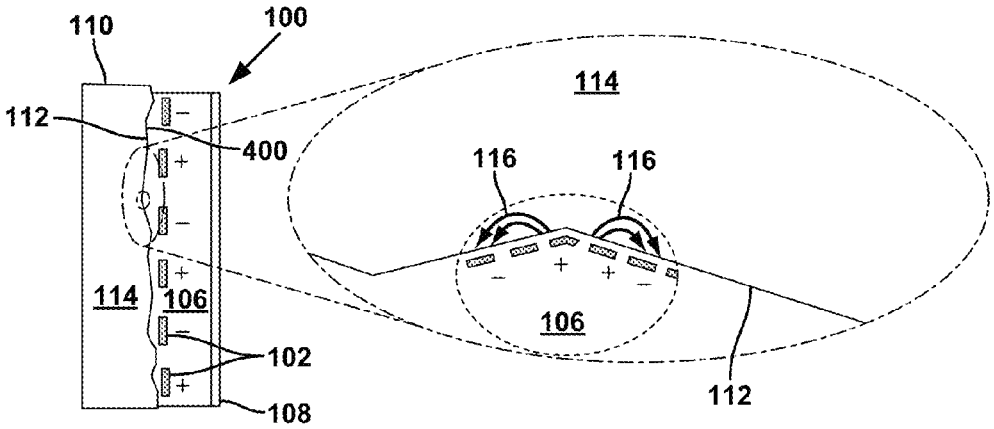
FIG. 4A illustrates in side cross-sectional regular and close-up views a deformable electroadhesive device conforming to the shape of a rough surface on a foreign object, in accordance with an example embodiment.
Figure 4B:
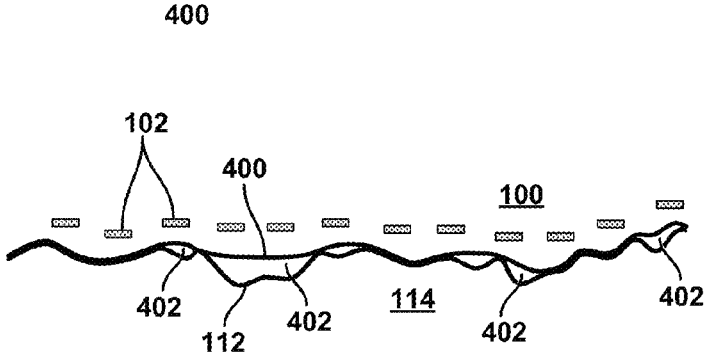
FIG. 4B illustrates in partial side cross-sectional view a surface of a deformable electroadhesive device initially when the device is brought into contact with a surface of a structure or foreign object, in accordance with an example embodiment.
Figure 4C:
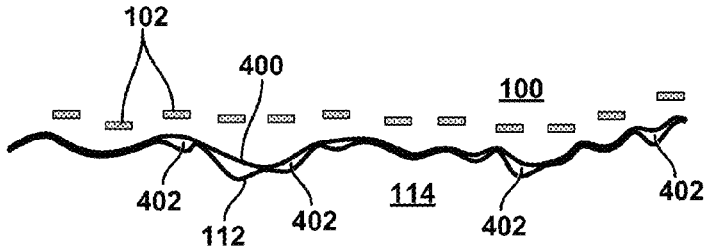
FIG. 4C illustrates in partial side cross-sectional view the surface shape of electroadhesive device of FIG. 4B and foreign object surface after some deformation in the electroadhesive device due to the initial force of electrostatic attraction and compliance, in accordance with an example embodiment.

Another distinguishing feature of electroadhesive devices described herein is the option to use deformable surfaces and materials in electroadhesive device 100 as shown in FIG. 4A-4C. In one example, one or more portions of electroadhesive device 100 are deformable. In a example, this includes surface 400 on device 100, as shown in FIG. 4B. In another example, insulating material 106 between electrodes 102 is deformable. Electroadhesive device 100 may achieve the ability to deform using material compliance (e.g., a soft material as insulating material 106) or structural design (e.g., cilia or hair-like structures). In an example, insulating material 106 includes a bendable but not substantially elastically extendable material (for example, a thin layer of mylar). In another example, insulating material 106 may include a soft polymer with modulus less than about 10 MPa and more specifically less than about 1 MPa.

Electrodes 102 may also be compliant. Compliance for insulating material 106 and electrodes 102 may be used in any of the electroadhesive device arrangements 100 described above. Compliance in electroadhesive device 100 permits an adhering surface 400 of device 100 to conform to surface 112 features of the object it attaches to. FIG. 4A shows a compliant electroadhesive device 100 conforming to the shape of a rough surface 112.

Adhering surface 400 is defined as the surface of an electroadhesive device that contacts the substrate surface 112 being adhered to. The adhering surface 400 may or may not include electrodes. In one example, adhering surface 400 may include a thin and compliant protective layer that is added to protect electrodes that would otherwise be exposed. In another example, adhering surface 400 may include a material that avoids retaining debris stuck thereto (e.g., when electrostatic forces have been removed). Alternatively, adhering surface 400 may include a sticky or adhesive material to help adhesion to a wall surface or a high friction material to better prevent sliding for a given normal force.

Compliance in electroadhesive device 100 may improve adherence. When both electrodes 102 and insulating material 106 are able to deform, the adhering surface 400 may conform to the micro- and macro-contours of a rough surface 112, both initially and dynamically after initial charge has been applied. This dynamic compliance is described in further detail with respect to FIG. 4B. This surface electroadhesive device 100 compliance enables electrodes 102 to get closer to surface 112, which increases the overall clamping force provided by device 100. In some cases, electrostatic forces may drop off with distance (between electrodes and the wall surface) squared. The compliance in electroadhesive device 100, however, permits device 100 to dynamically improve and maintain contact with surface 112, thereby increasing the applied holding force applied by the electrodes 102. The added compliance can also provide greater mechanical interlocking on a micro scale between surfaces 112 and 400 to increase the effective friction and inhibit sliding.

The compliance permits electroadhesive device 100 to conform to the wall surface 112 both initially and dynamically after electrical energy has been applied. This dynamic method of improving electroadhesion is shown in FIGS. 4B and 4C, in accordance with example embodiments. FIG. 4B shows the surface 400 of electroadhesive device 100 initially when the device 100 is brought into contact with surface 112 of a structure with material 114. Surface 112 may include roughness and non-uniformities on a macro, or visible, level (for example, the roughness in concrete can easily be seen) and a microscopic level (most materials).

At some time when the two are in contact as shown in FIG. 4B, electroadhesive electrical energy is applied to electrodes 102. This creates a force of attraction between electrodes 102 and wall surface 112. However, initially, as a practical matter for most rough surfaces, as can be seen in FIG. 4B, numerous gaps 402 are present between device surface 400 and wall surface 112. The number and size of these gaps 402 affects electroadhesive clamping pressures. For example, at macro scales electrostatic clamping is inversely proportional to the square of the gap between the material 114 and the charged electrodes 102. Also, a higher number of electrode sites allows device surface 400 to conform to more local surface roughness and thus improve overall adhesion. At micro scales, though, the increase in clamping pressures when the gap is reduced is even more dramatic. This increase is due to Paschen's law, which states that the breakdown strength of air increases dramatically across small gaps. Higher breakdown strengths and smaller gaps imply much higher electric fields and therefore much higher clamping pressures. Clamping pressures may be increased, and electroadhesion improved, by using a compliant surface 400 of electroadhesive device 100, or an electroadhesion mechanism that conforms to the surface roughness.

When the force of attraction overcomes the compliance in electroadhesive device 100, these compliant portions deform and portions of surface 400 move closer to surface 112. This deformation increases the contact area between electroadhesive device 100 and wall surface 112, increases electroadhesion clamping pressures, and provides for stronger electroadhesion between device 100 and foreign object 110. FIG. 4C shows the surface shape of electroadhesive device 100 and wall surface 112 after some deformation in electroadhesive device 100 due to the initial force of electrostatic attraction and compliance. Many of the gaps 402 have become smaller.

This adaptive shaping may continue. As the device surface 400 and wall surface 112 get closer, the reducing distance there between in many locations further increases electroadhesion forces, which causes many portions of electroadhesive device 100 to further deform, thus bringing even more portions of device surface 400 even closer to wall surface 112. This increases the contact area, increases clamping pressures, and provides for stronger electroadhesion between device 100 and foreign object 110. The electroadhesive device 100 reaches a steady state in conformity when compliance in the device prevents further deformation and device surface 400 stops deforming.

In some examples, electroadhesive device 100 may include porosity in one or more of electrodes 102, insulating material 106 and backing 108. Pockets of air may be trapped between surface 112 and surface 400. These air pockets may reduce adaptive shaping. Tiny holes or porous materials for insulator 106, backing 108, and/or electrodes 102 allows trapped air to escape during dynamic deformation. Thus, electroadhesive device 100 may be suited for use with rough surfaces, or surfaces with macroscopic curvature or complex shape. In one example, surface 112 includes roughness greater than about 100 microns. In another example, surface 112 includes roughness greater than about 3 millimeters.

An optional backing structure 108, such as shown in FIGS. 1A and 4A, can attach to insulating material 106 and include a rigid or non-extensible material. Backing layer or structure 108 can provide structural support for the compliant electroadhesive device. Backing layer 108 also permits external mechanical coupling to the electroadhesive device to permit the device to be used in larger devices.

With some electroadhesive devices 100, softer materials may warp and deform too much under mechanical load, leading to suboptimal clamping. To mitigate these effects, electroadhesive device 100 may include a graded set of layers or materials, where one material has a low stiffness or modulus for coupling to the wall surface and a second material, attached to a first passive layer, which has a thicker and/or stiffer material. Backing structure 108 may attach to the second material stiffer material. In an example, electroadhesive device 100 included an acrylic elastomer of thickness approximately 50 microns as the softer layer and a thicker acrylic elastomer of thickness 1000 microns as the second support layer. Other thicknesses may be used.

The time it takes for the changes of FIGS. 4B and 4C may vary with the electroadhesive device 100 materials, electroadhesive device 100 design, the applied control signal, and magnitude of electroadhesion forces. The dynamic changes can be visually seen in some electroadhesive devices. In one example, the time it takes for device surface 400 to stop deforming can be between about 0.01 seconds and about 10 seconds. In other cases, the conformity ceasing time is between about 0.5 second and about 2 seconds.

In some examples, electroadhesion as described herein permits fast clamping and unclamping times and may be considered almost instantaneous. In one example, clamping or unclamping may be achieved in less than about 50 milliseconds. In another example, clamping or unclamping may be achieved in less than about 10 milliseconds. The response speed may be increased by several means. If the electrodes are configured with a narrower line width and closer spacing, then the response speed is increased using conductive or weakly conductive substrates because the time needed for charge to flow to establish the electroadhesive forces is reduced. Using softer, lighter, more adaptable materials in device 100 may also increase speed. It is also possible to use higher voltage to establish a given level of electroadhesive forces more quickly, and response speed can also be increased by overdriving the voltage temporarily to establish charge distributions and adaptations quickly. To increase unclamping speeds, a driving voltage that effectively reverses polarities of electrodes 102 at a constant rate may be employed. Such a voltage prevents charge from building up in substrate material 114 and thus allows faster unclamping. Alternatively, a moderately conductive material 106 can be used between the electrodes 102 to provide faster discharge times at the expense of some additional driving power required.

As the term is used herein, an electrostatic adhesion voltage refers to a voltage that produces a suitable electrostatic force to couple electroadhesive device 100 to a wall, substrate or other object. The minimum voltage needed for electroadhesive device 100 will vary with a number of factors, such as: the size of electroadhesive device 100, the material conductivity and spacing of electrodes 102, the insulating material 106, the wall or object material 114, the presence of any disturbances to electroadhesion such as dust, other particulates or moisture, the weight of any structures mechanically coupled to electroadhesive device 100, compliance of the electroadhesive device, the dielectric and resistivity properties of the substrate, and the relevant gaps between electrodes and substrate. In one example, the electrostatic adhesion voltage includes a differential voltage between the electrodes 102 that is between about 500 volts and about 10 kilovolts. In a specific embodiment, the differential voltage is between about 2 kilovolts and about 5 kilovolts. Voltage for one electrode can be zero. Alternating positive and negative charges may also be applied to adjacent electrodes 102.

Various additional details and examples regarding electroadhesion and applications thereof can be found at, for example, U.S. Pat. Nos. 6,586,859; 6,911,764; 6,376,971; 7,411,332; 7,551,419; 7,554,787; and 7,773,363; as well as International Patent Application No. PCT/US2011/029101;

and also U.S. patent application Ser. No. 12/762,260, each of the foregoing of which is incorporated by reference herein.

II. Active Electrostatic Cleaning

As noted above, electroadhesion can involve using compliant or flexible pads or other surfaces with one or more electrodes to achieve reversible adhesion to various foreign objects. Such arrangements can generally be used to facilitate the attachment of electroadhesive devices to wall surfaces or other substrates, as well as the picking, placement and otherwise handling of smaller foreign objects. Although the foregoing illustrations have focused primarily upon attaching an electroadhesive device to a wall or other similarly large substrate, reverse arrangements can also apply in that relatively smaller objects can be electrostatically adhered to a larger electrostatic device.

As such, the various foregoing electroadhesive concepts can generally also be applied to the cleaning or picking up of debris such as dust, leaves and other similar particles and objects. In fact, various electroadhesive sheets, pads, electrolaminate devices and other similar applications of electroadhesion have been found to interact suitably with a variety of household particles, such as dust, hair, leaves, dirt, pebbles, glass shards, crumbs, other organic matter, similar small objects and the like. Such interactions can be favorably manipulated in a controlled manner to result in a wide variety of efficient cleaning devices, systems and techniques.

Various particular applications can include indoor uses, such as a duster, broom, vacuum substitute or other household interior cleaner, for example. Other particular applications can include a variety of outdoor uses, such as a leaf collector or trash or recycling collecting system, for example. There are also many ways in which the device can be optimized for dusting and other applications involving the collection or cleaning of fine or minute particles, as set forth in greater detail below.

Figure 5:
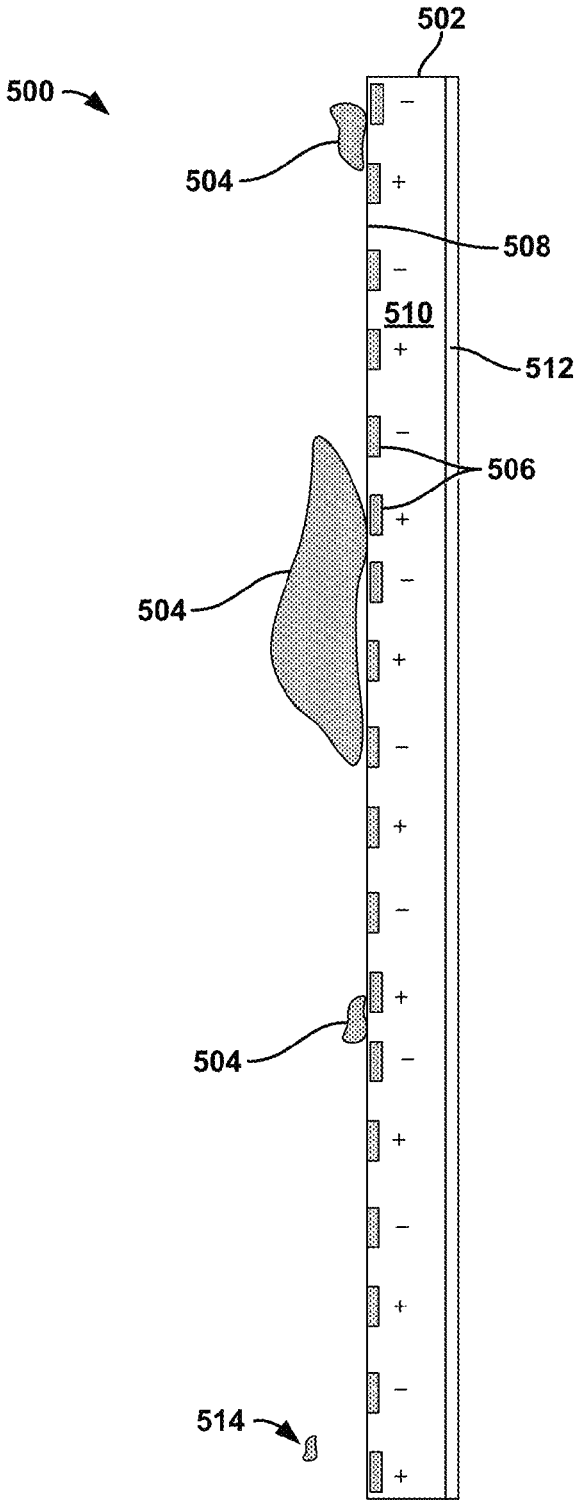
FIG. 5 illustrates in side cross-sectional view an electroadhesive device having a plurality of smaller foreign objects adhered thereto, in accordance with an example embodiment.

FIG. 5 illustrates an electroadhesive device having a plurality of smaller foreign objects adhered thereto, in accordance with an example embodiment. The electroadhesive device is presented in side cross-sectional view as a general application of a relatively larger device that can be used to adhere to smaller items. Overall environment 500 can include an electroadhesive device 502 that is configured to adhere a plurality of foreign objects 504 thereto. Any or all of foreign objects 504 can include debris such as dust, dirt, pebbles, crumbs, hair, garbage and/or a wide variety of other particulate matter. Many other items can also be adhered to the electroadhesive device 502.

Similar to the foregoing general examples above, electroadhesive device 502 can include one or more electrodes 506 located at or near an "electroadhesive gripping surface" 508 thereof, as well as an insulating material 510 between electrodes 506 and a backing 512 or other supporting structural component. Such backing 512 may not be used in all embodiments, and the insulating material 510 and/or backing 512 can be rigid or flexible, as may be desirable for a particular application. For example, the entire electroadhesive device 502 can be a flexible sheet in some instances. For purposes of illustration, electroadhesive device 502 is shown as having eighteen electrodes in nine pairs; however, more or fewer electrodes can be used in a given electroadhesive device. Further, electrodes 506 can be spread out in more than one dimension, such as across an entire surface in two dimensions.

Also similar to the foregoing general examples, an electroadhesive force can be "felt" or experienced by each individual foreign object or particle 504 that is adhered to surface 508. In general, a given individual particle can be more susceptible to experiencing an individual electroadhesive force where the foreign object or particle 504 is big enough to be in comparable size with and/or to span at least two oppositely charged electrodes 506.

In some examples, various foreign objects or debris or particles 514 might be too small to be adhered effectively to the electroadhesive device 502. This can be caused by such particles not being big enough to span across multiple electrodes 506. Where a given particle 514 is so small that it would experience being proximate a single electrode 506, then a resulting electroadhesive force may be minimal or nonexistent with respect to such a small foreign object or particle. Accordingly, smaller electrodes 506 and spacing between electrodes can generally result in an ability to adhere smaller foreign objects and particles 504 and 514. Such size and spacing of electrodes 506 can be referred to as the "pitch" in an overall electrode pattern, with a smaller pitch resulting in an improved ability to adhere smaller foreign objects and particles. It should be noted that it is possible to adhere to particles that are smaller than the spacing between electrodes. For example, sand can be picked up by electrodes with a pitch of approximately 3 mm. Various design and operational considerations with respect to variable pitches can provide useful in the ability to clean and/or control differing sizes of objects and particles, as set forth in greater detail below.

Figure 6A:
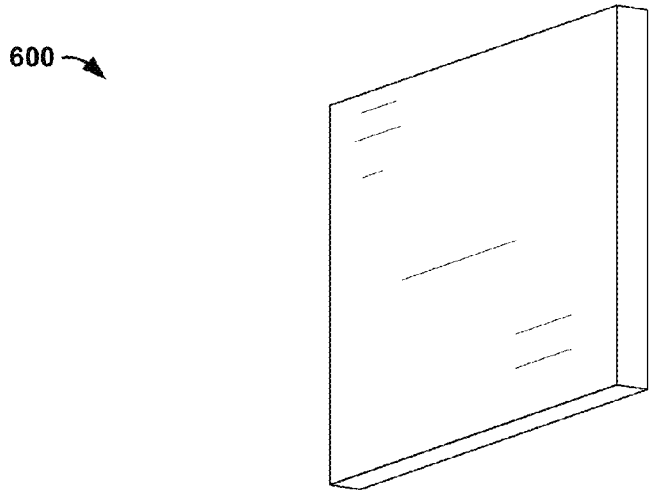
FIG. 6A illustrates in front perspective view an electroadhesive cleaning pad with its power supply turned off, in accordance with an example embodiment.

FIG. 6A illustrates an electroadhesive cleaning pad with its power supply turned off in front perspective view, in accordance with an example embodiment. Overall environment 600 can include an active electroadhesive cleaning pad that can be identical or significantly similar to foregoing electroadhesive device 502 in many regards. This active electroadhesive cleaning pad can have, for example, an interactive front surface and a plurality of electrodes (not shown) that are disposed at, proximate to, or behind the electroadhesive surface. An active power supply, such as a battery, capacitor, A/C source, or other suitable controllable power source (not shown) can supply a voltage to the electrodes in a controlled manner upon the actuation of a user input, for example. Such a user input can be made by way of a user input component, which can be a switch, button, knob, dial, or other similar component. As shown in environment 600, no power has been applied, such that no voltage is present at the electrodes and no electroadhesive force is present at the electroadhesive surface. As would be expected, no foreign objects or particles are adhered to the electroadhesive surface as a result.

Figure 6B:
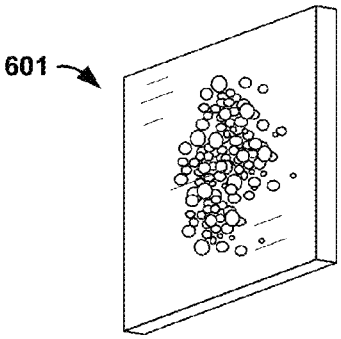
FIGS. 6B-6E illustrate in front perspective view the electroadhesive cleaning pad of FIG. 6A with its power supply turned on and various types of particulate matter being adhered thereto, in accordance with an example embodiment.
Figure 6C:
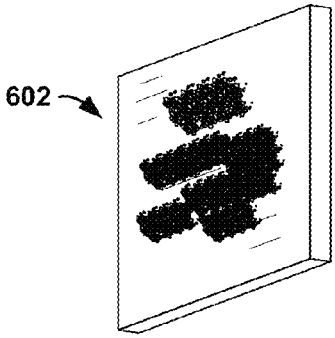
Figure 6D:
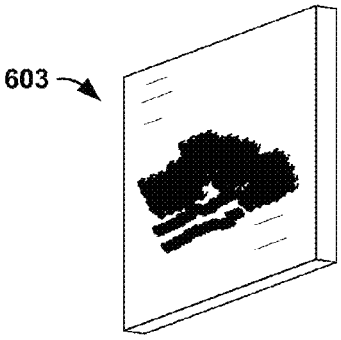

FIGS. 6B-6E each illustrate in similar front perspective views the active electroadhesive cleaning pad of FIG. 6A with its power supply turned on and various types of particulate matter or debris being adhered thereto, in accordance with example embodiments. As a first example, environment 601 in FIG. 6B depicts how a plurality of pebbles adheres to the electroadhesive cleaning pad. FIG. 6C shows an environment 602 where the cleaning pad has a collection of dirt adhered thereto, while FIG. 6D shows an environment 603 where a significant amount of dust is adhered to the cleaning pad. In addition to these examples, hair, crumbs, garbage, and a wide variety of other particulate matter and foreign objects can be adhered to the cleaning pad.

Figure 6E:
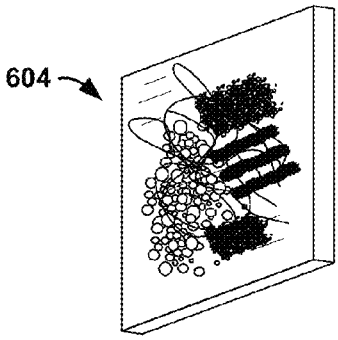

FIG. 6E depicts an environment 604 where a mixed variety of pebbles, dirt, dust and hair are all adhered to the electroadhesive cleaning pad at the same time. A robust adhesion of such particulate matter and other foreign objects to the electroadhesive pad can be achieved while the applied voltage is turned on. Such robust adhesion is sufficient to maintain the positions of the various objects and particulate matter even during a reasonable amount of shaking of or contact with the electroadhesive pad. When the voltage is removed (e.g., power is shut off) such that the various electroadhesive forces with respect to the particulate matter items is reduced or eliminated, these foreign particles and items tend to readily fall away from the electroadhesive pad. As such, control of the applied voltage can result in significant control of the various particulate matter and other foreign objects adhered to the electroadhesive pad, device or system.

In examples, the electroadhesive cleaning pads depicted in FIG. 6A-6E could be used as a hand duster or a feather duster. For instance, a hand duster may include a handle coupled to the electroadhesive cleaning pad. The hand duster may be applied directly to a surface of any type (wood, ceramic or any surface) to be cleaned by, for example, swiping the electroadhesive cleaning pad across the surface to be cleaned. In some examples, the hand duster may not include a handle, and the electroadhesive cleaning pad can be held by a hand of a user and swiped over the surface to be cleaned to remove any debris thereon. In examples, the electroadhesive cleaning pads can be made into feather-like shapes for use as a feather duster. Or, electroadhesive cleaning means can be coupled to preexisting feathers of the feather duster. A feather duster may include a wooden handle (or a handle made of any other material) coupled to feathers that are wound onto the handle by a wrapped wire, for example. In some example, the dusters may have retractable casing instead of the handle. Flexible feathers, and electroadhesive cleaning means coupled thereto, allow the duster to reach place that are difficult to reach by other types of dusters.

It should be noted that in some examples the electroadhesive cleaning pad may be configured to adhere to, or comply with a shape of, the surface to be cleaned. However, in other examples, the electroadhesive cleaning pad may be configured to adhere to debris (e.g., dust, dirt, pebbles, etc.) without adhering to the surface to be cleaned. Still in other examples, the electroadhesive cleaning pad may be configured to adhere partially to the surface to be cleaned and partially to the debris to be removed from the surface to be cleaned.

Depending on the various specific effects desired, the material or materials used for the electroadhesive surface could be varied. The electroadhesive surface material could be soft and tacky in nature, such as in the form of soft polyurethanes or silicones, whereby additional passive adhesion forces could be created. Alternatively, more slippery surfaces could be used for the electroadhesive surface material, such that the surface could be more easily cleaned. Such slippery surface materials could include one or more sheets of polyurethane, for example. Other types of materials could also be used to form all or portions of the electroadhesive surface, as may be desired, and such other materials can include various fabrics, fibers, cloth, plastics, etc.

In addition to the types of materials used, various shapes, arrangements and configurations of the electroadhesive surface or surfaces can also affect the amount of compliance between the electroadhesive surface and the various foreign objects and particulate matter to be cleaned. For example, when picking up relatively dried out and flat leaves that have a complex shape, flexibility of the electroadhesive surface may improve electroadhesion. As such, thin sheets that flexibly drape around relatively thin, larger and complex foreign objects, such as dried leaves, can be useful for these particularized applications. When picking up very small objects on a flat electroadhesive surface, or when picking up fresh and pliable leaves, however, an electroadhesive pad having a more rigid backing has been found to be adequate. Compliance can also be achieved through structural means such as cilia, flaps and/or other similar features on the electroadhesive surface. As such, an overall larger pad or other electroadhesive cleaning device can include a relatively stiff backing coupled with numerous smaller hairs or flaps on the electroadhesive surface itself to provide the compliance necessary to conform around the foreign objects to be cleaned. Such features can resemble the bristles or fibers found in common cleaning implements such as mops, brooms, brushes, dusters and the like, for a combined mechanical and electroadhesive cleaning of foreign objects.

Figure 7A:
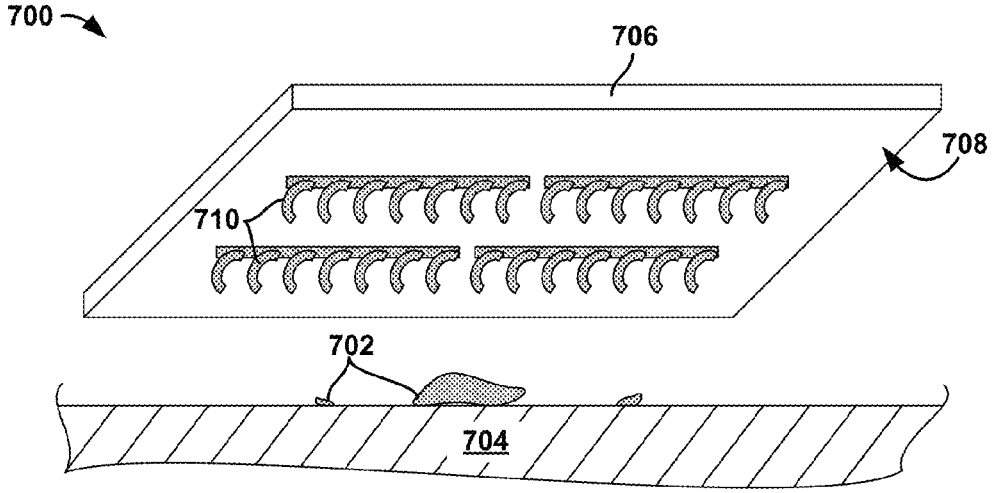
FIG. 7A illustrates in side elevation view an active electroadhesive cleaning device having hair or fibers along its electroadhesive surface, in accordance with an example embodiment.

FIG. 7A illustrates an electroadhesive cleaning device having bristles or cilia along its electroadhesive surface shown in side elevation view, in accordance with an example embodiment. As shown, environment 700 includes a plurality of foreign objects 702 that are dispersed about ground or floor surface 704. An active electroadhesive cleaning device 706 can include a variety of components that are fronted by an electroadhesive surface 708 that is configured to interact with the various foreign objects 702. One or more hairs or cilia 710 can be dispersed about electroadhesive surface 708 to aid in the compliance and adherence of the foreign objects 702 to the electroadhesive surface.

One or more electrodes (not shown) disposed behind or otherwise located proximate to the electroadhesive surface can also be used to generate electroadhesive forces with respect to each of foreign objects 702 when the electroadhesive surface 708 contacts the foreign objects 702 or is placed in reasonably close proximity thereto. As noted above, the cilia 710 and/or one or more other features located at or about the electroadhesive surface 708 can result in a deformable surface or surface region, such that the deformable surface portion can move closer to a respective foreign object 702 when the electroadhesive force is applied thereto.

Figure 7B:
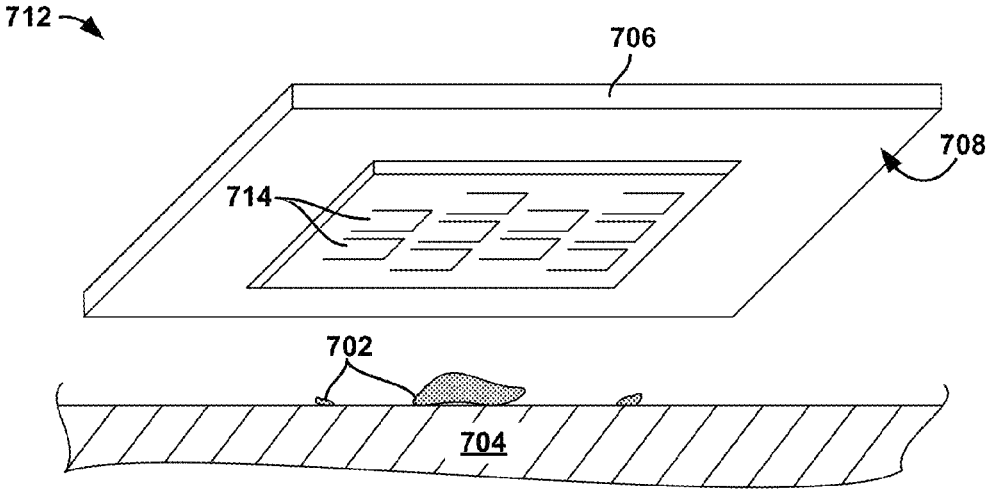
FIG. 7B in side elevation view an active electroadhesive cleaning device having a plurality of extendable flaps along its electroadhesive surface, in accordance with an example embodiment.

FIG. 7B illustrates in side elevation view another compliance example in the form of an active electroadhesive cleaning device having a plurality of extendable flaps along its electroadhesive surface, in accordance with an example embodiment. Alternative environment 712 can include the same or substantially similar particulate matter or foreign objects 702 along the ground or another floor surface 704. A similar active electroadhesive cleaning device 706 can have an electroadhesive surface 708 to be placed proximate the foreign objects to be cleaned, as in the foregoing embodiment. Instead of (or in addition to) cilia, however, the electroadhesive surface 708 in environment 700 can include a plurality of flaps 714 that are partially coupled to and extendable from the electroadhesive surface. Such flaps can be adapted to carry electroadhesive charge, similar to the foregoing electroadhesive surfaces, but are much more flexible and compliant with respect to contacting the foreign objects to be cleaned.

Another feature that can be used effectively to control and manipulate particulate matter and other foreign objects to be cleaned can involve the use of patterned electrodes. As noted above, finer electrode patterns may be more optimal for smaller sized particles, such that each individual particle "feels" the electrical field across a plurality of oppositely charged electrodes, in contrast to being subject to a single electrode and thus typically a single polarity. Larger electrode patterns may interact with correspondingly larger or more conductive objects, such as leaves or larger trash items, for example. By designing electrode patterns appropriately, it is possible to tune what types of objects can be carried or otherwise manipulated for cleaning. It is also possible to have a relatively fine electrode pattern where changing the connectivity or addressing appropriate electrode regions can tune the electroadhesion to the sized objects of interest. Thus, electroadhesion can be used not only as a general cleaner but also as a specific cleaner to separate out certain object or debris sizes or materials from others that may be present on a surface to be cleaned. This concept is illustrated with respect to FIGS. 8A through 9C.

Figure 8A:
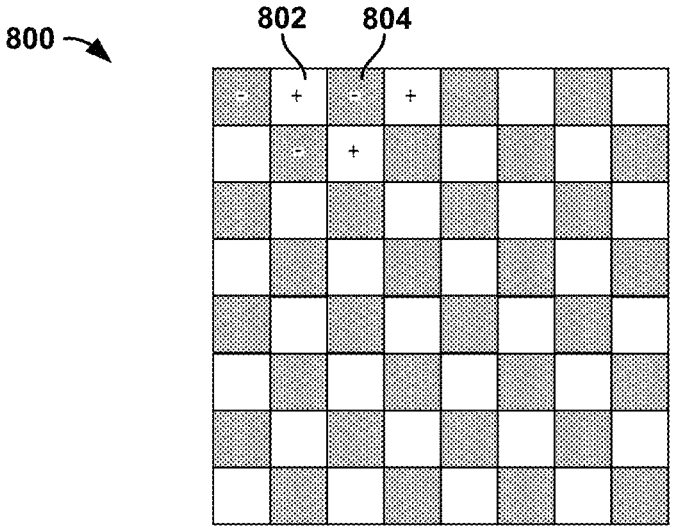
FIG. 8A illustrates in top plan view a checkerboard type electrode pattern for use with respect to a suitable electroadhesive surface, in accordance with an example embodiment.

FIG. 8A illustrates a checkerboard type electrode pattern for use with respect to a suitable electroadhesive surface shown in top plan view, in accordance with an example embodiment. A suitable power source, one or more user input devices or components, electroadhesive surface(s) and other components can be used in conjunction with the electrodes shown in electrode pattern 800, but that such items are not displayed here for purposes of simplicity in illustration and discussion.

Electrode pattern 800 can involve a checkerboard arrangement of alternating positively and negatively charged regions. This can be accomplished, for example, by alternating positive and negative charges across each of the electrodes in the pattern. As shown, electrode 802 can be positively charged, while adjacent electrode 804 can be negatively charged. This alternating charged pattern can continue in two dimensions across the entire electrode pattern 800. Where this is done at the individual electrode level, as in pattern 800, then the smallest pitch possible for that pattern can be observed. That is, pattern 800 is configured such that it will be able to attract the smallest foreign objects that it possibly can. Such smallest foreign objects possible might generally be about the size of one electrode given the simple geometry of this particular pattern.

Figure 8B:
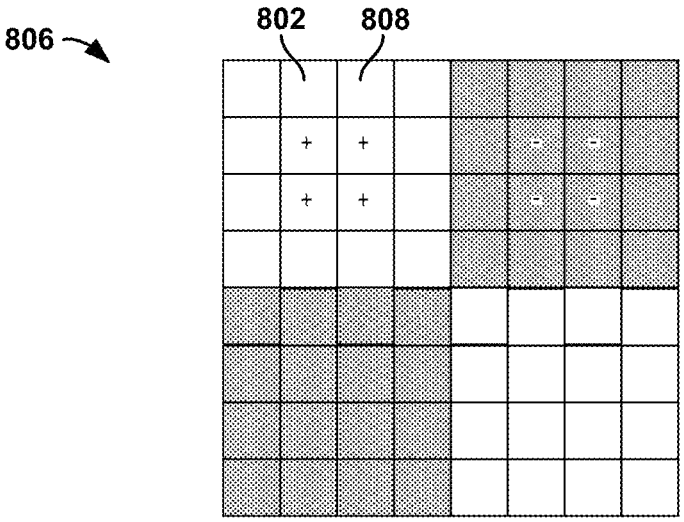
FIG. 8B illustrates in top plan view the checkerboard type electrode pattern of FIG. 8A having an alternatively charged configuration, in accordance with an example embodiment.

FIG. 8B illustrates the checkerboard type electrode pattern of FIG. 8A having an alternatively charged configuration in top plan view, in accordance with an example embodiment. Alternatively configured electrode pattern 806 is notably formed on the same electrodes and components as pattern 800 is. That is, the same 64 electrodes may be used to form pattern 800 and alternative pattern 806. Unlike the finer pitch 64 alternating region pattern 800, the alternative pattern 806 is configured such that there are 4 alternating regions. This can be done by manipulating the charges at some of the electrodes such that an effectively larger pitch is created. For example, while the charge on electrode 802 stays the same, the adjacent electrode 808 (replacing electrode 802) has had its charge switched from negative to positive. Similar charge switches to various other electrodes in the 64 electrode pattern have also been made to achieve the simpler four region result.

A variety of other electrode patterns can alternatively be achieved by manipulating the charge to each of the electrodes in a similar manner. For example, a 4×4 pattern can similarly be achieved, in addition to the 8×8 and 2×2 patterns shown in FIGS. 8A and 8B. Alternatively, other patterns such as 4×2, 1×1, and 2×1 can also be configured. Further, the number of electrodes or effective electrode regions is not limited to 64, and can be smaller than or substantially greater than this number. As such, numerous possible electrode arrangements are possible, with many such arrangements being configurable to numerous different electrode patterns. Such different electrode patterns can also have differing pitches.

FIGS. 9A-9D illustrate a more complex example of electrode patterns involving interdigitated electrode arrangements, in accordance with example embodiments. Starting with FIG. 9A, an example interdigitated electrode pattern of straight stripes for use with respect to a suitable electroadhesive surface is similarly shown in top plan view. The electrode pattern is being illustrated for purposes of simplicity. As shown in electrode pattern or arrangement 900, two electrodes 902 and 904 are present. Electrode 902 can be positively charged, while electrode 904 can be negatively charged, and the polarities of both electrodes can be reversible, as may be desired.

Electrodes 902 and 904 are interdigitated, such that numerous different regions for electroadhesive forces to form can be observed from just these two electrodes. Due to the particular geometry of electrodes 902 and 904, the pitch for this particular patterned arrangement would effectively be the width of an interdigitated "finger" in many instances. In the event that these fingers are relatively narrow then, the size of debris or particulate matter or other foreign objects that can be adhered to or otherwise handled by an electroadhesive cleaning device or system using patterned arrangement 900 would be relatively small.

Figure 9A:
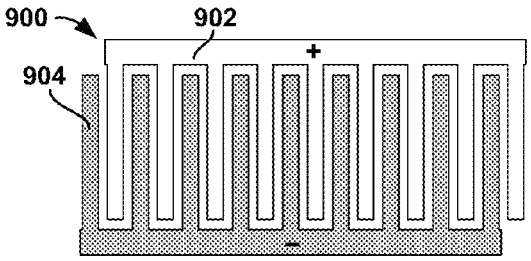
FIG. 9A illustrates in top plan view an interdigitated electrode pattern of straight stripes for use with respect to a suitable electroadhesive surface, in accordance with an example embodiment.
Figure 9B:
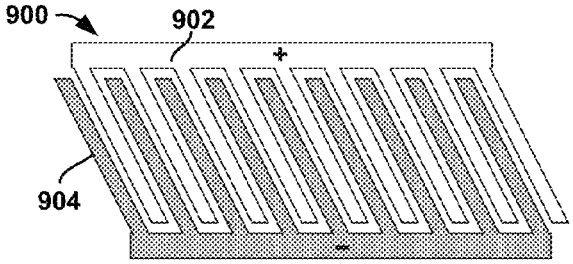
FIG. 9B illustrates in top plan view an interdigitated electrode pattern of diagonal stripes for use with respect to a suitable electroadhesive surface, in accordance with an example embodiment.

FIG. 9B illustrates in top plan view an interdigitated electrode pattern of diagonal stripes for use with respect to a suitable electroadhesive surface, in accordance with an example embodiment. The electrodes pattern shown in FIG. 9B is similar to the pattern shown in FIG. 9A, but the "fingers" or interdigitated electrodes are slanted to form diagonal stripes. Different angles can be used. Also, the straight stripes depicted in FIG. 9A and the diagonal stripes depicted in FIG. 9B are examples for illustration only, and any other pattern can be used.

Figure 9C:
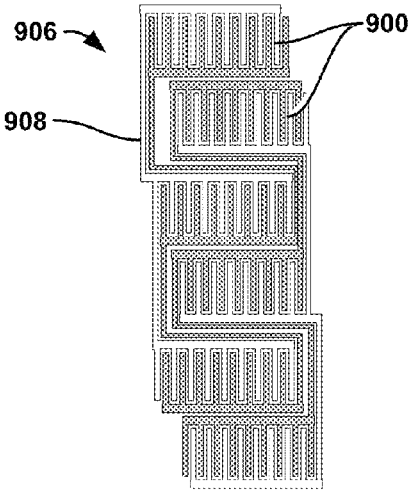
FIG. 9C illustrates in top plan view an interdigitated electrode pattern incorporating multiple repetitions of the pattern in FIG. 9A, in accordance with an example embodiment.

FIG. 9C similarly illustrates in top plan view an example interdigitated electrode pattern incorporating multiple repetitions of the pattern in FIG. 9A, in accordance with an example embodiment. Overall electrode pattern 906 includes six repeated instances or copies of pattern 900 from FIG. 9A. These "copies" of pattern 900 are effectively interdigitated within each other, and are then connected by common buses or connectors 908. Each such common bus or connector 908 can be used to couple like charged regions on a subset of the six repeated copies of pattern 900, such as on half of the repeated copies. In this particular example, each connector 908 can be arranged to connect similarly chargeable regions on alternating "fingers" 900 of overall pattern 906. That is, a single connector 908 would connect the positively (or alternatively negatively) charged regions of the first, third and fifth sub-patterns 900 within overall pattern 906. Similar connections 908 could then be made with respect to the second, fourth and sixth sub-patterns respectively.

When connected in this overall manner by connectors 908, the overall pattern 906 can then be manipulated to alter the observable pitch of the pattern. For a finer pitch, for example, all positive and negative electrode regions can be charged as shown at the finest possible levels across the entire pattern 906. For a larger pitch though, all of the interconnected regions on the first, third and fifth sub-patterns 900 can all be set to the same positive or negative charge, while all of the interconnected regions on the second, fourth and sixth sub-patterns 900 can all be set to the same charge that is opposite those of the other three sub-patterns. For example, the entirety of the first, third and fifth sub-patterns 900 can be positive, while the entirety of the second, fourth and sixth sub-patterns can be negative. This then results in a larger overall pitch for a result that would then tend to ignore particles of a size greater than the width of a single finger of electrode 902 but smaller than the overall width of the sub-pattern 900.

Figure 9D:
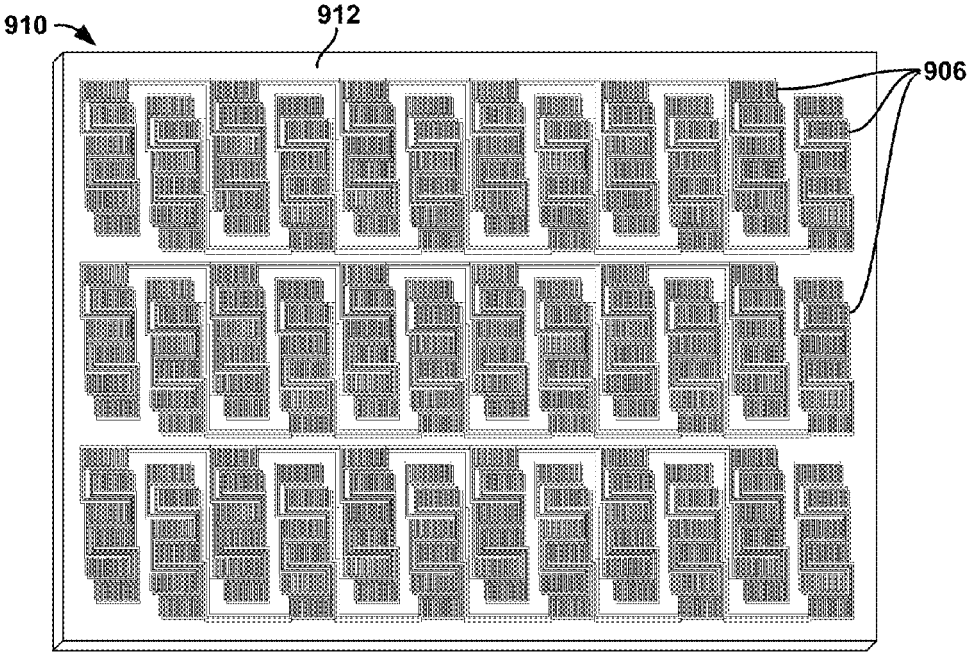
FIG. 9D illustrates in top plan view an electroadhesive surface of an electroadhesive cleaning device having an extended electrode pattern incorporating multiple repetitions of the pattern in FIG. 9C, in accordance with an example embodiment.

FIG. 9D extrapolates this concept into yet a further extended electrode pattern incorporating multiple repetitions of the pattern in FIG. 9C. As shown, overall electrode pattern 910 can be disposed behind or proximate an electroadhesive surface 912 of an electroadhesive cleaning device. A plurality of sub-patterns 906 that correspond to the overall pattern shown in FIG. 9C are provided in an interdigitated pattern themselves across overall electrode pattern 910 in multiple directions. Further common buses or connectors can be formed between each of the sub-patterns 906 such that additional control can be had with respect to designating the pitch on overall pattern 910. Further iterations of this process can also be implemented so as to add further control over designating pitch sizes. FIGS. 9C and 9D depict repetitions of the electrodes pattern shown in FIG. 9A as an example for illustration only, and the electrode pattern of diagonal stripes shown in FIG. 9B, or any other pattern, could be used as well.

Figure 10A:
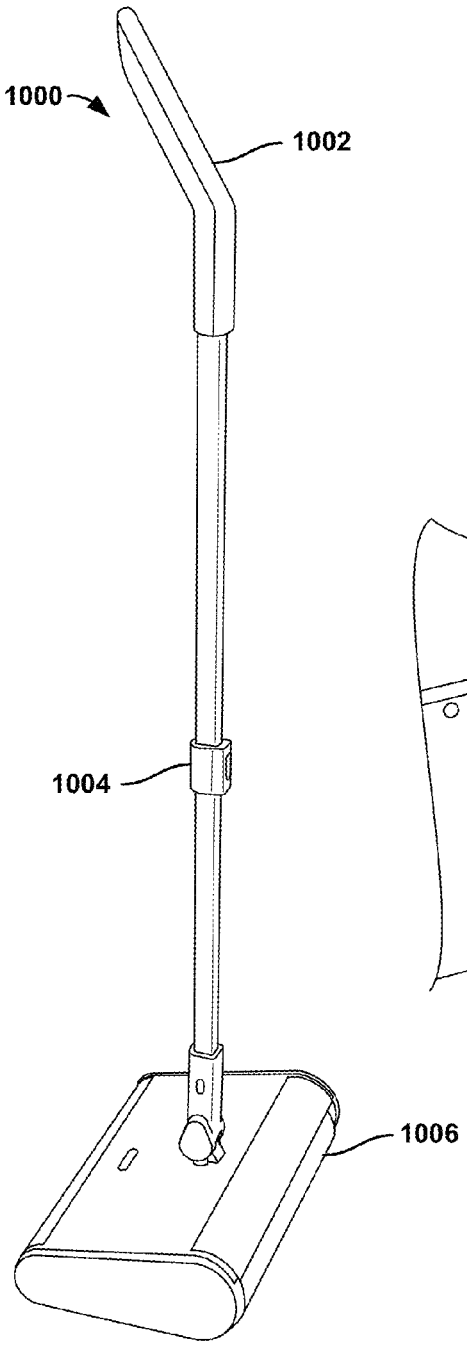
FIG. 10A illustrates a track-based electroadhesive cleaning device, in accordance with an example embodiment.

FIG. 10A illustrates a track-based electroadhesive cleaning device 1000, in accordance with an example embodiment. The device 1000 may include components such as a handle grip 1002, an adjustable-height handle 1004, and cleaning head 1006. These are example components for illustration and many other components can be included in the electroadhesive cleaning device 1000 configuration shown in FIG. 10A.

Figure 10B:
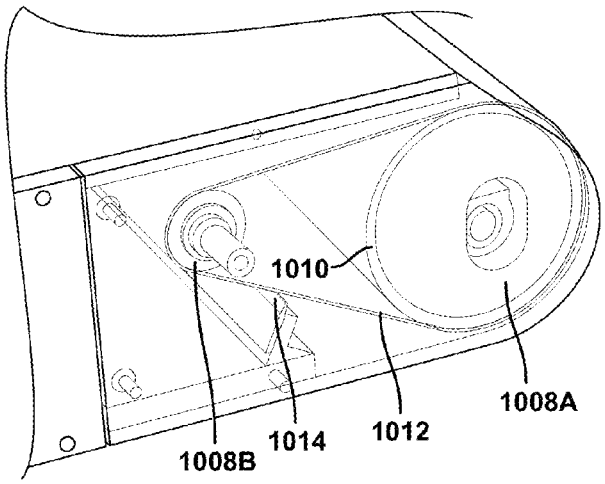
FIG. 10B illustrates a zoomed-in view of the track configuration for the electroadhesive cleaning device in FIG. 10A, in accordance with an example embodiment.

FIG. 10B illustrates a zoomed-in view of the track configuration for the electroadhesive cleaning device in FIG. 10A, in accordance with an example embodiment. FIG. 10B depicts components housed inside the cleaning head 1006 such as two rollers 1008A and 1008B and an electroadhesive pad 1010 covered by a belt 1012. The belt 1012 can include, for example, a thin plastic sheet that covers the electroadhesive pad 1010. The handle 1004 may include means (e.g., a button dial, knob, etc.) for controlling and/or modifying an input voltage that is applied to electrodes of the electroadhesive pad 1010. As the electroadhesive cleaning device 1000 is pushed forward or backward (e.g., using the handle 1004) on a surface having debris thereon, the electroadhesive pad 1010 rotates with the roller 1008A and causes the debris to electrostatically adhere to the belt 1012. Further, the electroadhesive cleaning device 1000 may include a scraper 1014 positioned close to or in contact with the belt 1012. As the belt 1012 rotates with the motion of the electroadhesive cleaning device 1000, the scraper 1014 may be configured to remove any debris adhered to the belt 1012 so as to clean the belt 1012. The roller 1008A can be configured to roll forwards or backwards relative to the motion of the cleaning device 1000, or the roller 1008A can be allowed to passively rotate with the contact friction from the surface to be cleaned.

Figure 10C:
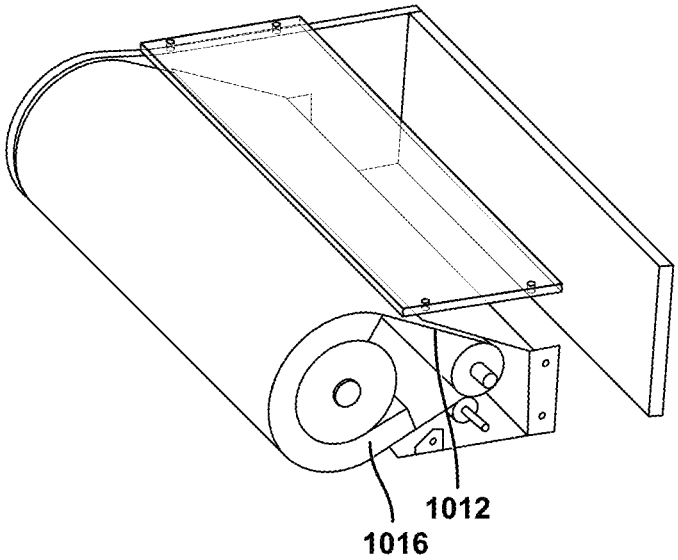
FIG. 10C illustrates portion of an alternative track-based electroadhesive cleaning device, in accordance with an example embodiment.

FIG. 10C illustrates portion of an alternative track-based electroadhesive cleaning device, in accordance with an example embodiment. In the arrangement depicted in FIG. 10C, the belt 1012 rotates over a stationary electroadhesive pad 1016 (including the electrodes). The belt 1012 includes no electrodes. Neither the electroadhesive pad 1016 nor the electrodes therein rotate with the belt 1012. In some examples, this configuration shown in FIG. 10C may improve debris removal from the belt 1012 (by a scraper such as the scraper 1014, for example). Debris attached to a portion of the belt 1012 close to the electroadhesive pad 1016 may be strongly attached to the belt 1012. As the belt 1012 rotates away from the electroadhesive pad 1016, the debris is less strongly attached to the belt 1012 and is easier to remove.

Figure 10D:
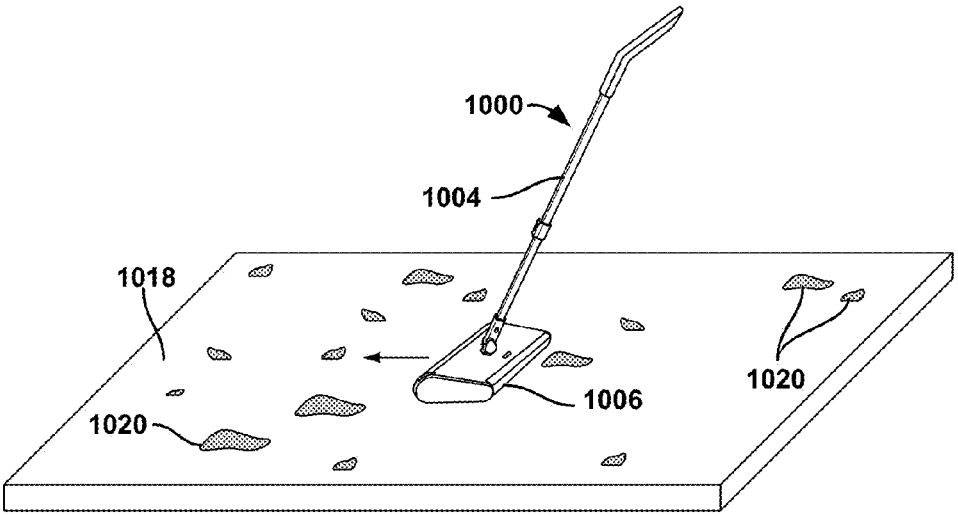
FIG. 10D illustrates the track-based electroadhesive cleaning device cleaning a surface, in accordance with an example embodiment.

FIG. 10D illustrates in side perspective view the track-based electroadhesive cleaning device 1000 cleaning a surface 1018, in accordance with an example embodiment. Track-based electroadhesive cleaning device 1000 can be configured to move across and clean debris or foreign objects 1020 from ground or floor surface 1018. In addition to having a power supply or source, input component(s), and various electrodes similar to those described in greater detail above, cleaning device 1000 also includes a number of additional features. The handle 1004 can be provided for a user to manually operate or manipulate the overall device 1000, such as in a forward motion (indicated by the arrow) across surface 1018. In some examples, the cleaning head 1006 may be configured to house one or more rollers (e.g., 1008A and 1008B) and additionally a power supply, such as battery, driving electronics, such as high voltage DC-DC converters, other pertinent switches and circuitry. The cleaning head 1006 may also contain an electric motor to actively drive the rotation of the belt 1012 or a mechanical transmission to drive the roller rotation at a particular speed and/or direction relative to the travel direction of the cleaning head 1006 over the surface 1018.

The electroadhesive surface can be configured in the form of a continuous loop or track situated across one or more rollers 1008A and 1008B, and the various electrodes (not shown) can be arranged in a pattern behind or adjacent to the electroadhesive surface. As the device 1000 moves across surface 1018, voltage is applied at the electrodes proximate the portion of the electroadhesive surface beneath the device, such that particulate matter and/or foreign objects 1020 on the foreign surface 1018 are adhered to that portion of the electroadhesive surface that is beneath the device 1000 and has electroadhesive forces being conducted therethrough.

As the tracked electroadhesive surface or belt 1012 departs foreign surface 1018 at the front side of the device 1000 during the motion of the device 1000, at least some of the foreign objects 1020 can remain adhered to the belt 1012 and are thus carried up and away from the surface 1018 and across the upper tracked portion of the device 1000 accordingly.

Figure 10E:
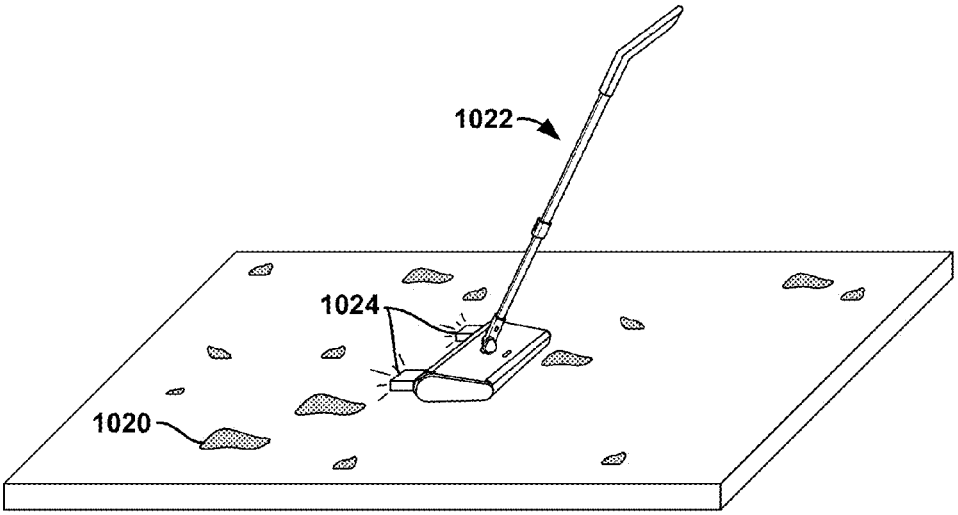
FIG. 10E illustrates in side perspective view an alternative track-based electroadhesive cleaning device having ion charge sprayers, in accordance with an example embodiment.

FIG. 10E illustrates in side perspective view an alternative track-based electroadhesive cleaning device 1022 having ion charge sprayers 1024, in accordance with an example embodiment. Alternative track-based electroadhesive cleaning device or system 1022 can be similar to the foregoing device 1000 in a number of respects. In addition to having an identical or similar handle, rollers, and continuous tracked electroadhesive surface, the device or system 1022 can also include one or more ion charge sprayers 1024. Such ion charge sprayer(s) 1024 can spray or otherwise disperse ionic charges in front of the cleaning device or system 1022.

In this arrangement or system, a respective electroadhesive surface, sheet, or belt might have one electrode associated therewith, with such a single electrode being only positively or negatively charged. As such, the sprayed ionic charges can be of the opposite polarity from the single charge across the tracked electroadhesive surface or belt. For example, the ion charge sprayers 1024 can spray negative charges on foreign dust particles, while the electroadhesive surface would be charged positively such that it picks up all of the now affirmatively negatively charged dust particles. One advantage of this embodiment is that the polarity of the charge on the dust or debris particles and other foreign objects 1020 to be cleaned can be accurately predicted, since specific ion charges to that effect are being sprayed. As such, the electroadhesive surface can be simpler in that it might require a single electrode of a polarity that is opposite to the sprayed charge.

In these particular tracked electroadhesive cleaning device examples, as well as in various other examples, several additional device and system aspects can apply. For example, the magnitude of voltage on an electroadhesive clamping component or components can be varied to pick up various specifically targeted objects, such as by size and/or weight. Such targeting can also be accomplished by using a patterned electrode arrangement with variable pitches, as detailed above.

It is also contemplated that alternating the polarity of the electroadhesive clamping components can provide several advantages. For example, the particles or other foreign objects are less likely to become damaged or disadvantageously charged up themselves when first clamped and then released, such as by reducing, shutting off or reversing the polarity of the applied charge. In some cases, it may be possible to use this phenomenon to disperse or repel the particles or foreign objects away from the electroadhesive surface in a desirable or otherwise controllable manner. Where a direct current pulse is used, for example, a negative polarity pulse for a short duration can helps with the prompt release or repelling of dirt and other foreign objects from the electroadhesive surface.

In various examples, the disclosed electroadhesive cleaning devices and systems can employ a mechanical means of releasing the dust or other foreign objects more fully when the voltage is at different stages, such as fully on, reduced, switched off, or even reversed. Some approaches in helping to remove particles and foreign objects from the electroadhesive surface can include jolting the device, such as with an electromagnetic solenoid, for example, vibrating the device, such as with an electromagnetic coil or embedded electroactive polymer device, for example, or the use of an air or water jet that is squirted parallel to the face of the electroadhesive surface. Since reducing or switching off the input voltage often does not often result in a full release of particles, and especially lighter particles such as dust, it may be desirable to use a mechanical wiper or brush to help clean or recycle the electroadhesive surface.

One way to do this continuously is in continuous tracked or a roller embodiment. The electroadhesive surface can be in the form of an electroadhesive track or belt that can have several distinct patterns or sections along its length. In such an arrangement, a front roller, which can be non-rotating and has the electrodes coupled thereon, can be used to charge the electroadhesive surface as it begins to contact the foreign surface to be cleaned, and a rear roller can be used to discharge the electroadhesive surface or belt after the surface and adhered foreign objects rotate up and away from the foreign surface being cleaned. In some examples, electroadhesion electronics can be mounted fully inside front and/or back rollers. Other types of electroadhesive surfaces can also be employed for such cleaning purposes, including "flattened tire" and "wheels with flap" designs, such as those described in U.S. Pat. No. 7,554,787, which is incorporated herein by reference.

Figure 10F:
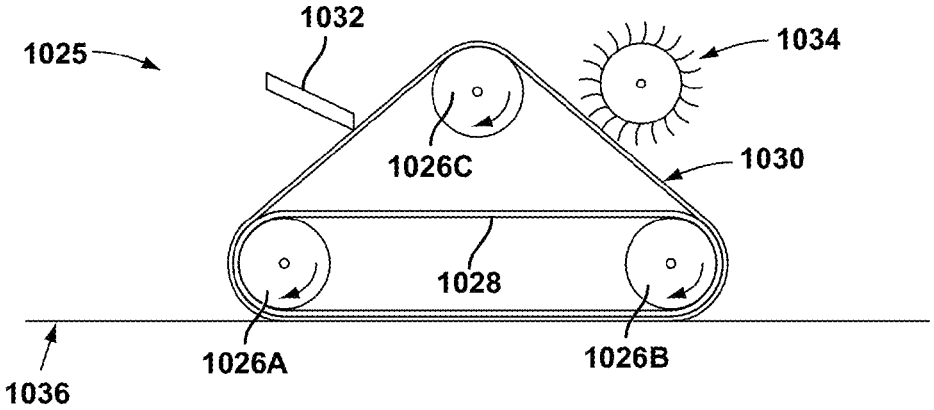
FIG. 10F illustrates a cleaning arrangement for a track-based electroadhesive cleaning device, in accordance with an example embodiment.

FIG. 10F illustrates a cleaning arrangement for a track-based electroadhesive cleaning device, in accordance with an example embodiment. The cleaning arrangement depicted in FIG. 10F may be referred to as a "self-cleaning" arrangement that can be implemented for any of the forgoing electroadhesive devices described above. FIG. 10F depicts a track-based electroadhesive device 1025 including three rollers 1026A, 1026B, and 1026C; however, a greater or fewer number of rollers can be used. One or more of the roller may be powered by, for example, an electric motor to drive the device 1025. The device 1025 also includes an electroadhesive pad 1028, a belt or thin sheet 1030 (can be made of a dielectric material, for example), a scraper 1032, and a brush 1034. As the device 1025 moves over or across a surface 1036 to be cleaned, when voltage is applied to the electroadhesive pad 1028, debris on the surface 1036 may be electroadhesively attached to the belt 1030. As the belt 1030 moves, or rotates, away from the surface 1036, the scraper 1032 removes the debris adhered to the belt 1030. Further, if not all the debris is removed from the belt 1030 by the scraper 1032, the brush 1034 may be configured to remove some of the debris that remained attached to the belt 1030. In some examples, the scraper 1032 may be used without the brush 1034, and in other examples, the brush 1034 may be used without the scraper 1032 for cleaning the belt 1030. The arrangement shown in FIG. 10F is an example for illustration and different arrangements can be used with different components can be implemented to clean the belt 1030 and/or the pad 1028. For instance, instead of using the brush 1034, a sponge can be used instead to clean the belt 1030. Other examples are possible.

In examples, the electroadhesive pad 1028 may be non-rotating (i.e., locked) and the rollers 1026A and 1026B may be locked. In these examples, to clean the belt 1030 and/or the pad 1028, the rollers 1026A and 1026B may be quickly spun to perform a cleaning cycle by causing the belt 1030 and the pad 1028 to rotate and thus causing the scraper 1032 and/or brush 1034 to remove debris adhered to the belt 1030 and/or pad 1028.

Figure 10G:
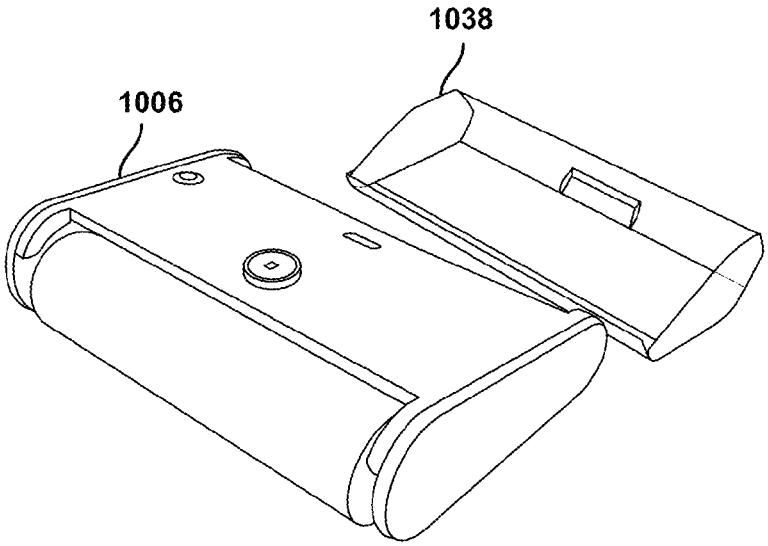
FIG. 10G illustrates the electroadhesive cleaning device having a tray to collect debris, in accordance with an example embodiment.

FIG. 10G illustrates the electroadhesive cleaning device having a tray to collect debris, in accordance with an example embodiment. For example, as a scraper and/or brush cleans a belt of an electroadhesive cleaning device by removing debris attached to the belt, the debris removed can be collected in a tray. FIG. 10G depicts a tray 1038 (e.g., a dustbin or other receptacle) that can be assembled into, and removed from, the cleaning head 1006. As a given cleaning mechanism (e.g., a scraper and/or a brush) removes dirt adhered to the belt, the removed dirt can be collected in the tray 1038, which can later be removed to be cleaned and reinstalled into the cleaning head 1006. In such embodiments where a belt is configured to rotate over an electroadhesive pad, the electroadhesive pad is generally not contacting debris over the surface to be cleaned, and thus may not require cleaning. The belt requires cleaning and may be a removable part that can be replaced overtime without having to replace the electroadhesive pad.

Thus, electroadhesive surfaces such as the electroadhesive pads shown in FIGS. 6A-6E and the continuous electroadhesive belt or track described with respect to FIGS. 10A-10G can be treated as a consumable or disposable that can be changed after several cleaning operations. In some examples, many thin layer pads or tracks can be stacked on top of each other, such that a user can simply peel off and dispose of the outermost pad or track layer when it gets too old, damaged or dirty. In such instances, due care should be taken to ensure that the electric field produced by the electroadhesive pad sufficiently penetrates through the material of the track or belt, even in its thickest configuration, such that the electroadhesion forces are present on the surface of the track or belt.

Figure 10H:
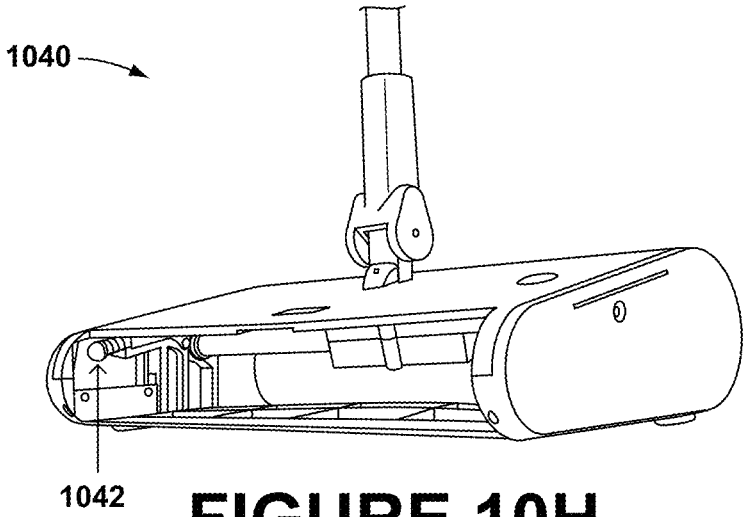
FIG. 10H illustrates a back view of a track-based electroadhesive cleaning device, in accordance with an example embodiment.
Figure 10I:
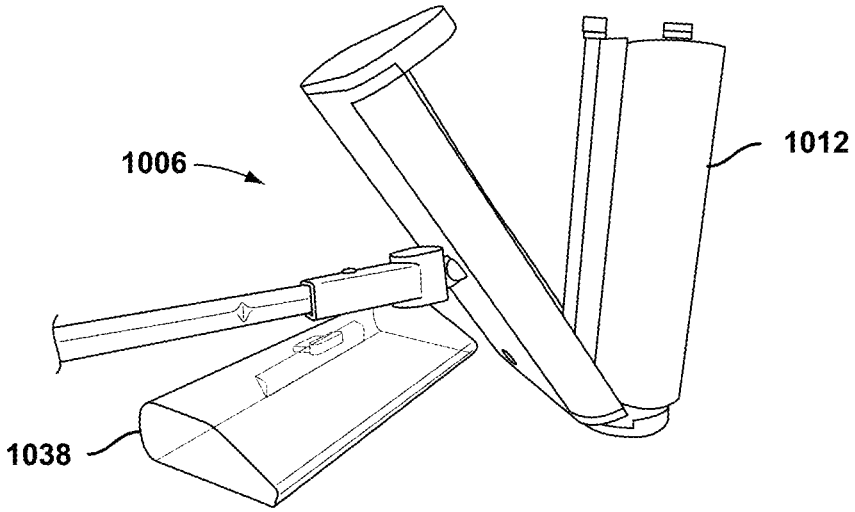
FIG. 10I illustrates a modular track-based electroadhesive cleaning device with the tray to collect debris and replaceable belt or replaceable roller, in accordance with an example embodiment.

FIG. 10H illustrates a back view 1040 of a track-based electroadhesive cleaning device, in accordance with an example embodiment; and FIG. 10I illustrates a modular track-based electroadhesive cleaning device with the tray and a replaceable belt or replaceable roller, in accordance with an example embodiment. The back view 1040 depicts a button 1042 (with a spring mechanism) that, when pressed, opens the cleaning head 1006 to facilitate belt 1012 or electroadhesive pad 1010 removal or replacement. The modular design shown in FIG. 10I also depicts the tray 1038 that can be removed and reinstalled within the cleaning head 1006. Such modular design facilitates removal and replacement of the belt and/or electroadhesive pad after several cleaning operations and considering the belt and/or pad as consumable or disposable items. In examples where a belt is configured to rotate over an electroadhesive pad and the electroadhesive pad does not contact debris over the surface to be cleaned, only the belt may be replaceable, and the electroadhesive pad does not need to be replaced.

Other types of cleaning devices are also envisioned in addition to the foregoing examples. For example, a rolling device with an embedded motor can be configured to move on its own, similar to commercially available self-propelled vacuum cleaning robots. A wall climbing robot, for example, can clean a foreign surface as it climbs the surface and possibly does other operations, such as inspection. Flat active electroadhesive cleaning pads similar to those shown in FIGS. 6A-6E can be used as cleaning patches in applications where rolling motion is either unnecessary or undesirable. A significantly large active electroadhesive cleaning pad can be configured to be removable wallpaper (e.g., transparent, plain colored or decorative) that effectively lines the inside of a room, for example. As dust or pollen and other allergens move around inside the room due to Brownian motion, such particles may stick to the active electroadhesive cleaning wall paper. Periodically, a user can simply switch off the active electroadhesion and wipe the wallpaper with a separate conventional cleaning device, such as a cloth. Electroadhesion also allows conformability, and lends itself to wearable devices, such as a mask or respirator device or embedded into clothes. In such cases, electroadhesion can act to trap dust on its own, which may be in addition to filters that can be woven into fabrics and/or other materials comprising the mask.

Figure 11A:
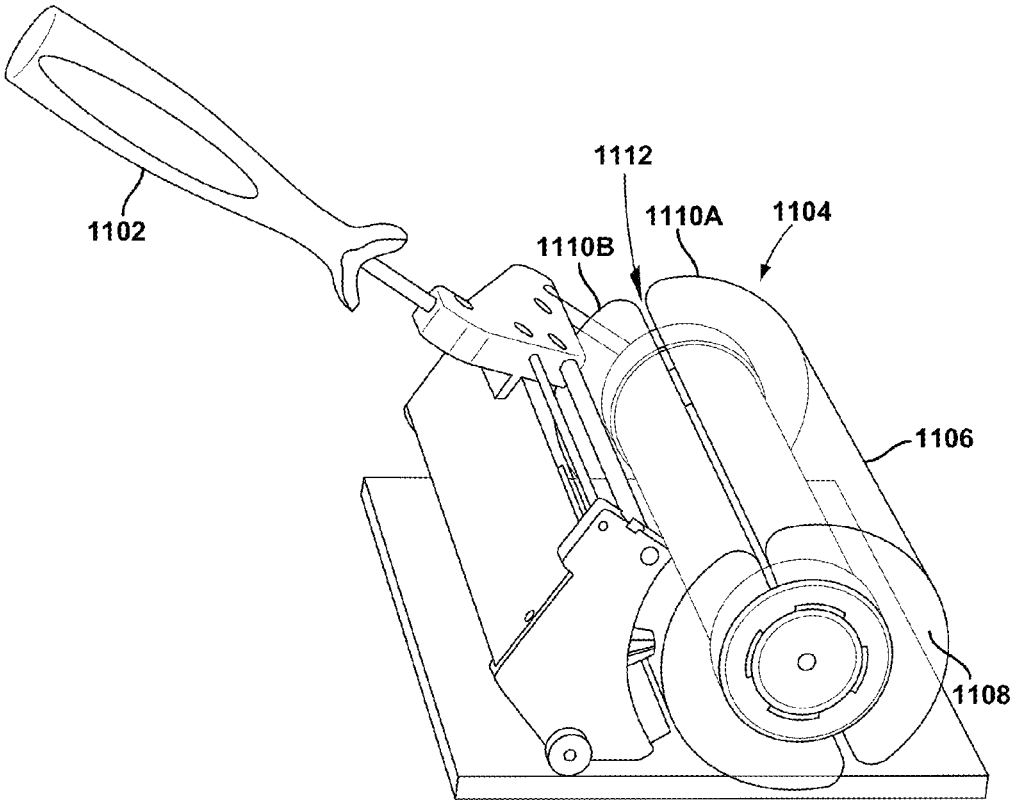
FIG. 11A illustrates an alternative arrangement for an electroadhesive cleaning device, in accordance with an example embodiment.

FIG. 11A illustrates an alternative arrangement for an electroadhesive cleaning device, in accordance with an example embodiment. FIG. 11A depicts the electroadhesive cleaning device having a short handle 1102 suitable for cleaning walls, for example. However, in other examples, a longer handle can be used and the electroadhesive cleaning device can be used to clean any type of surface. The electroadhesive cleaning device may include a single roller 1104. The roller 1104 may include an electroadhesive pad 1106 (having electrodes embedded therein, for example) on a compliant backing 1108. The roller 1104 may include more than one pad per roller in some examples. The roller 1104 may, in some examples, be made of double shell design having a first shell 1110A and a second shell 1110B to facilitate keeping any conductive material inside the roller 1104 for safety, i.e., all the electrical connections can be made internal to the roller. An adhesive film can be used at seam 1112 for stress relief and to maintain a circular cross section for the roller 1104, for example. FIG. 11A depicts a modular design for the electroadhesive cleaning device 1100 where the roller 1104 can be easily removed and replaced with a new roller when needed.

Figure 11B:
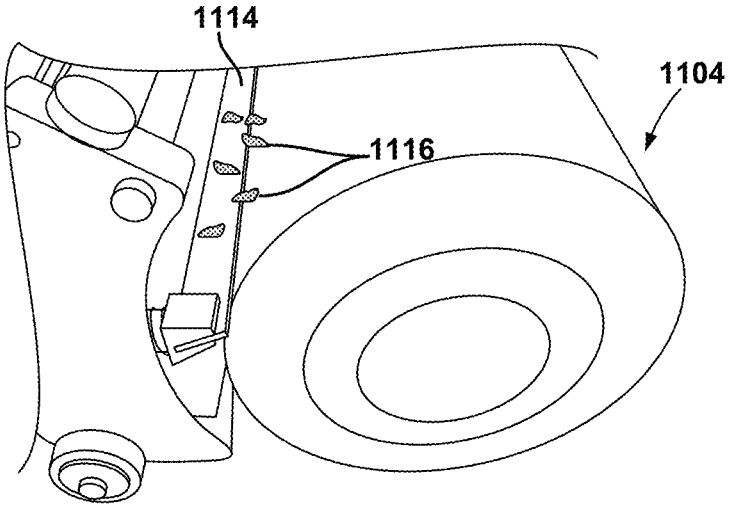
FIG. 11B illustrates a scraper in contact with the roller to remove debris removed during rotation of the roller, in accordance with an example embodiment.

FIG. 11B illustrates a scraper 1114 in contact with the roller 1104 to remove debris 1116 removed during rotation of the roller 1104, in accordance with an example embodiment. The scraper 1114 is depicted resting against the electroadhesive surface of the roller 1104. The scraper 1114 may be configured to, as the roller 1104 rotates, remove at least a portion of the debris 1116 adhered against the electroadhesive surface of the roller 1104. The scraper 1114 can be configured to rest on the electroadhesive surface of the roller 1104 at such an angle that is effective to enable the scraper 1114 to remove debris in both directions of travel of the roller 1104.

Figure 11C:
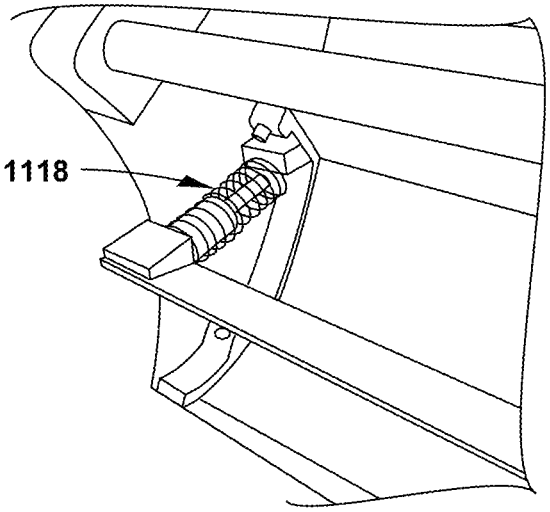
FIG. 11C illustrates a back view of the electroadhesive cleaning device showing a spring-loaded scraper, in accordance with an example embodiment.

FIG. 11C illustrates a back view of the electroadhesive cleaning device shown in FIG. 11A showing a spring-loaded scraper 1114, in accordance with an example embodiment. FIG. 11C depicts a spring 1118 loading or pushing against the scraper 1114 such that the scraper 1114 maintains contact with roller 1104 to effectively remove the debris 1116. Spring loading is just one example, as other mechanical means could be used to maintain contact between the scraper 1114 and the roller 1104.

Figure 12:
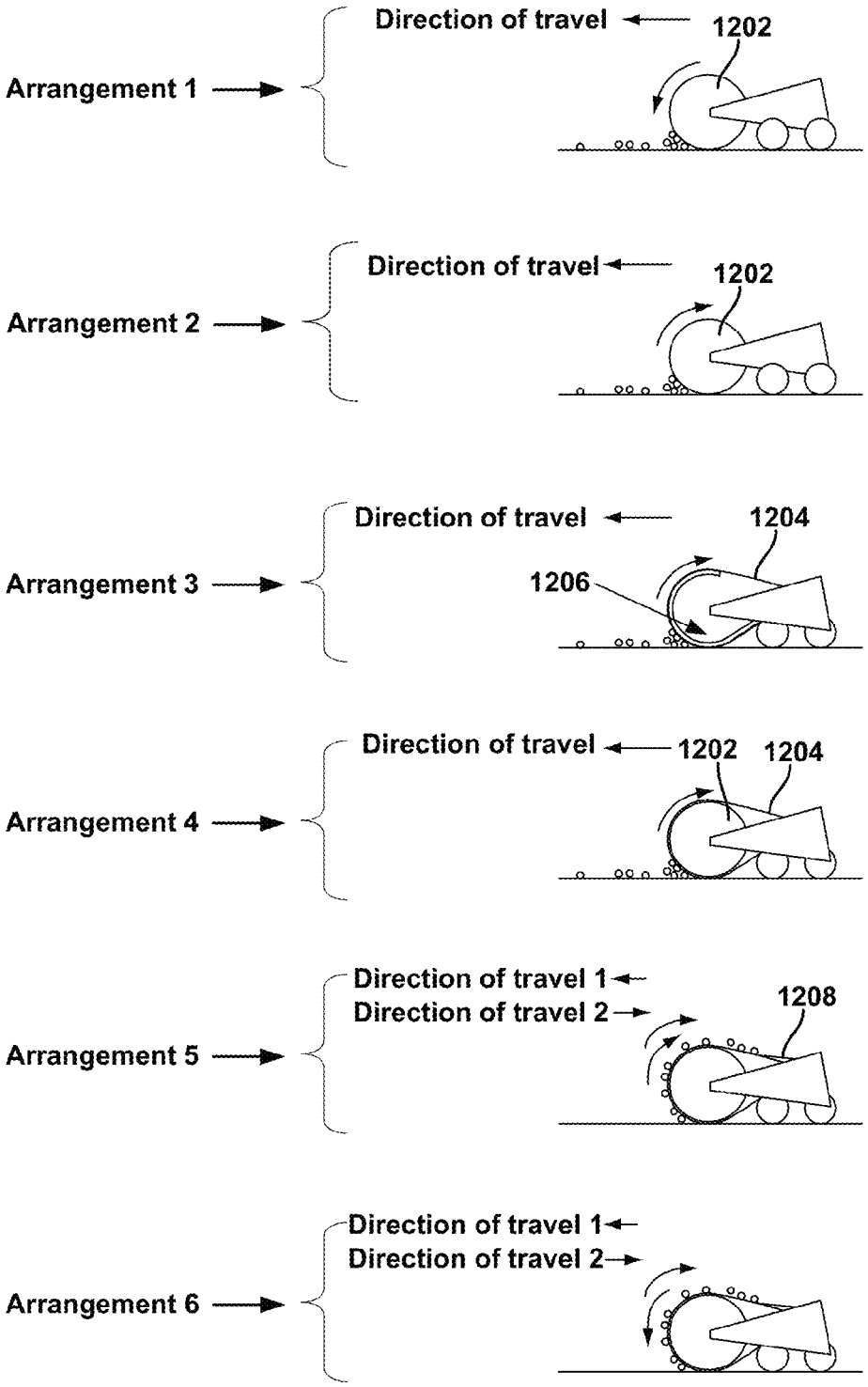
FIG. 12 illustrates various arrangements depicting respective rotational configurations for roller-based and track-based electroadhesive cleaning devices, in accordance with example embodiments.

FIG. 12 illustrates various arrangements depicting respective rotational configurations for roller-based and track-based electroadhesive cleaning devices, in accordance with example embodiments. Arrangement 1 depicts a roller-based electroadhesive cleaning device having a roller 1202. The roller may include or be coupled to electroadhesive pads and electrodes as described in the foregoing examples (e.g., description with respect to FIGS. 11A-11C), and may also include a soft foam backing or other type of compliant backing. In arrangement 1, the roller 1202 rotates in the same direction of travel (i.e., rolling along a surface to be cleaned). Arrangement 2 is similar to arrangement 1 except that the roller 1202 is rolling in a reverse direction. By driving the electroadhesive roller backwards relative to the direction of travel of the electroadhesive device on the surface to be cleaned, debris pickup rate may increase. The improvement in debris pick relative to arrangement 1 may be more prominent when the surface has more than one layer of dirt of debris thereon.

Arrangement 3 depicts an electroadhesive cleaning device similar to the electroadhesive cleaning device shown in FIG. 10C. The electroadhesive cleaning device in arrangement 3 includes a sheet belt 1204 wrapped around a stationary electroadhesive pad 1206 that can comprise electrodes that produce electroadhesion forces when a voltage is applied thereto. As described with respect to FIG. 10C, arrangement 3 may facilitate removing debris adhered to the belt 1204. In Arrangement 3 the belt 1204 is rolling backwards relative to the direction of travel of the electroadhesive device on the surface to be cleaned to improve debris pick up as described in arrangement 2.

Arrangement 4 depicts the sheet belt 1204 wrapped around the roller 1202. In this arrangement, both the belt and the roller may be rotating, or the roller may be stationary while the belt is rotating. In this example, the belt 1204 is rotating backwards relative to the direction of travel of the electroadhesive device on the surface to be cleaned to improve pick up. Arrangement 5 depicts a scraper 1208 added to arrangement 4. The scraper may be similar, for example, to the scraper 1114 shown in FIG. 11B or the scraper 1032 shown in FIG. 10F, and may be configured to remove debris attached to the belt. It is noted that arrangement 5 shows that the belt is configured to rotate in the same direction regardless of the direction of travel of the cleaning device. Thus, for direction of travel 1, the belt is rotating backwards; for direction of travel 2, the belt rotation does not change (e.g., roll along the surface to be cleaned). Arrangement 6 is similar to arrangement 5, but the belt is configured to change direction of rotation when the direction of travel of the electroadhesive cleaning device changes. The belt thus rotates backwards relative to the direction of travel regardless of the direction of travel.

As shown in FIG. 12, in some cases, a track-based cleaning device may include electrodes coupled to or embedded within, and thus rotating with, the track or belt. However, in other cases, the rotating tack or belt may include a sheet of dielectric material (e.g., a polymer material) that rotates over stationary electrodes; thus, the track or belt rotates relative to the stationary electrodes.

The configurations and arrangements shown in FIG. 12 are examples included for purposes of illustration. Other configurations or combinations of features and arrangements are possible as well. The rotation of rollers or belts may result from rolling on a surface to be cleaned, or the device may be powered (e.g., by an electric motor) that causes the rollers and/or belt to rotate.

Power for a given active electroadhesive cleaning device may come from a battery, capacitor or other storage device, for example. In some cases, the power can be generated by the motion of the cleaning device itself, similar to what is used in a Van de Graaf generator, for example. In some cases, it may also be possible to generate the required charges from the triboelectric effect of rubbing the cleaning device against the surface of interest, or internally against the body of the cleaning device. For example, such a result can be obtained where an electroadhesive surface in the form on an electroadhesion belt or track is driven forward. Where a given electroadhesive surface is desired to be used in a back and forth motion (e.g., as with typical household vacuum cleaners and carpet sweepers), the surface of the electroadhesive track or belt that is in contact with the surface to be cleaned can be kept at a high voltage, while the top surface of the track that is away from the surface to be cleaned can be held at ground potential. This can permit the active electroadhesive cleaning device to clean the target surface regardless of the direction of movement of the electroadhesive track. In such embodiments, the collecting belt or other similar component that collects charges from rotating around a roller or other similar component formed from a dissimilar material can be considered an input component for the device or system.

Figure 13:
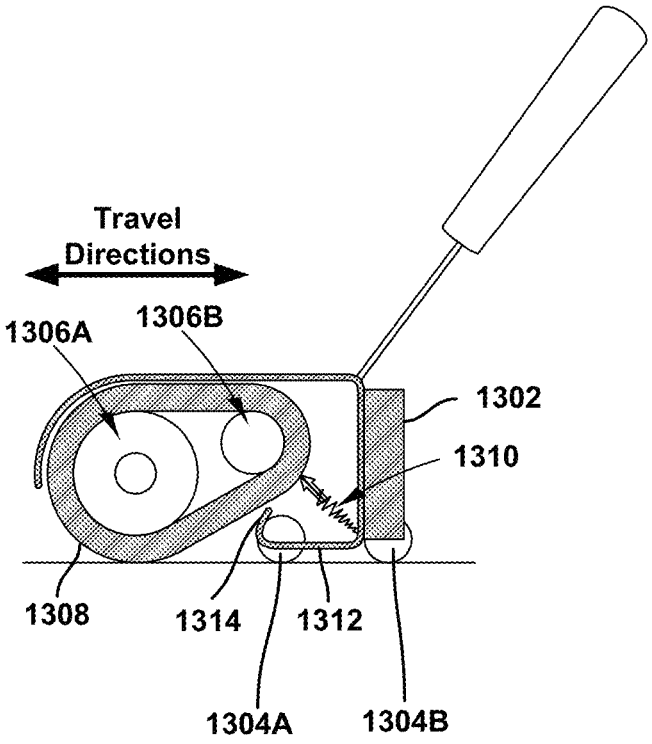
FIG. 13 illustrates an arrangement depicting a battery powering an electroadhesive cleaning device, in accordance with an example embodiment.

FIG. 13 illustrates an arrangement depicting a battery 1302 powering an electroadhesive cleaning device, in accordance with an example embodiment. The electroadhesive device includes rollers or wheels 1304A and 1304B for travel in both directions. The device also includes rollers 1306A and 1306B that can be used for rotating a belt or electroadhesive pad 1308. In some examples, the electroadhesive pad may be coupled to the roller 1306A separate from the belt 1308. Electrodes can be embedded in the belt 1308 or in the roller 1306A, for example. Other examples are possible. Electronics used to for operating the electroadhesive cleaning device depicted in FIG. 13 may be embedded within one or more of the rollers 1306A and 1306B. The device also includes a spring-scraper mechanism 1310 to clean debris adhered to the belt 1308. The scraper can be configured to have an angle that facilitates debris removal in both directions of travel of the device. The debris cleaned by the mechanism 1310 can be collected in a tray 1312 having a lip 1314 to prevent spilling.

The battery 1302 may be configured to power the device and any electronics configured to drive different functions of the cleaning device. Additionally, as shown in FIG. 13, the battery 1302 may be configured to be a counterweight that stabilizes the electroadhesive cleaning device.

As yet another possible feature, an added ability to sense dust, dirt or other foreign particles or items can be helpful. Such sensing can be accomplished by way of measuring the capacitance and/or resistance at one or more locations on the interactive or electrode surface. Changes in the capacitance and/or resistance can indicate that there is too much dirt or particulate matter on the electroadhesive surface. Such a sensed result can be acted upon in a number of ways. An alarm in the form of an indicator light or sound can let the user know that the surface may need to be cleaned or replaced. Alternatively, or in addition, sensing an increased amount of dirt or particulate matter can result in an automated response to repel the dirt, such as by way of a reversed polarity burst or pulse. The level or repetition of the burst or pulse can be increased as may be desirable in response to a sensed increase in dirtiness on the surface. In addition, sensing can be used to discriminate between different types of materials and/or different sizes of materials to be cleaned or manipulated.

The foregoing examples of electroadhesive devices described above depict a single roller or two rollers where one of them may be touching the surface to be cleaned while the other roller does not. However, in some examples, an electroadhesive device may include two or more rollers, each touching, and removing debris from, the surface to be cleaned.

Figure 14A:
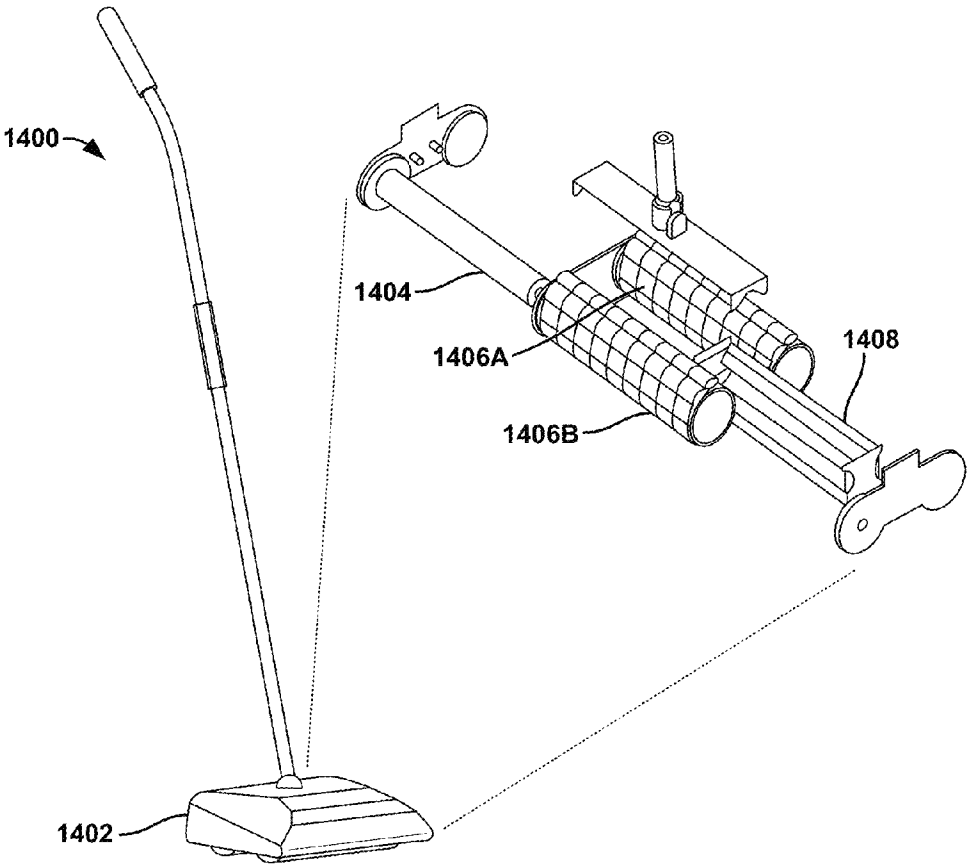
FIG. 14A illustrates an electroadhesive cleaning device 1400 having two rollers, in accordance with an example embodiment.

FIG. 14A illustrates an electroadhesive cleaning device 1400 having two rollers, in accordance with an example embodiment. FIG. 14A also illustrates an exploded view of a portion of contents of a cleaning head 1402 of the electroadhesive cleaning device 1400. The cleaning head 1402 includes an electroadhesive power module 1404 that may include a battery. The cleaning head 1402 also may include dual rollers 1406A and 1406B having electroadhesive surfaces coupled thereon. The electroadhesive surfaces may include or be proximate to electrodes that are powered by the power module 1404. In other examples, more rollers can be used. The cleaning head 1404 may also include a dust scraper and debris collection tray 1408.

Figure 14B:
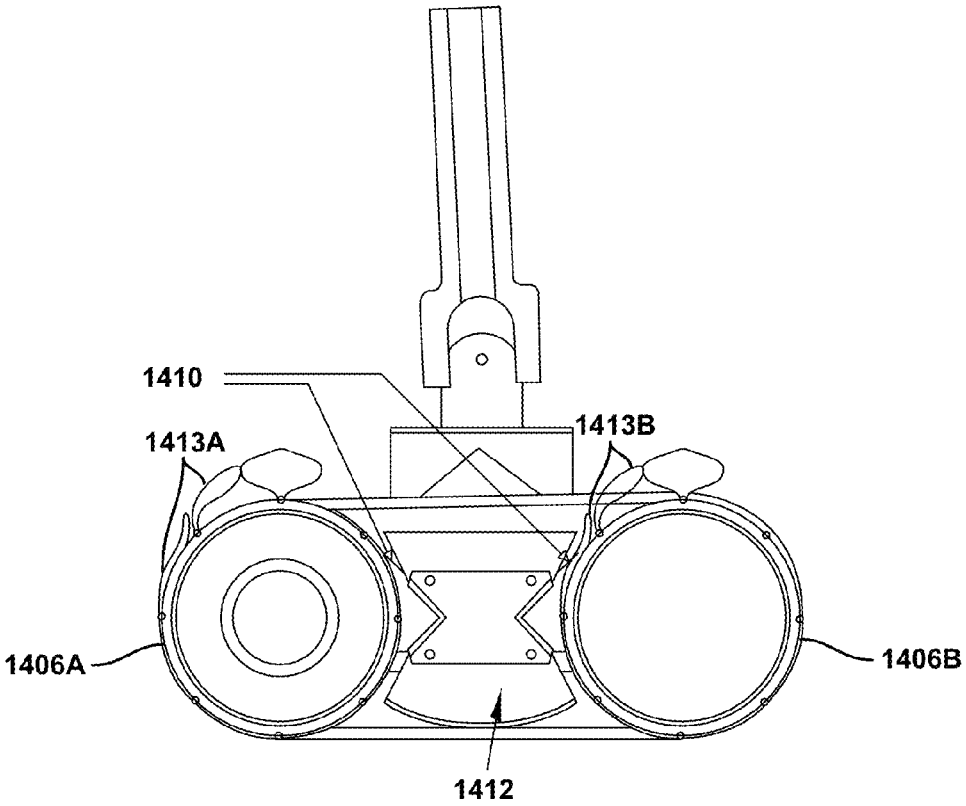
FIG. 14B illustrates another view of the rollers illustrated in FIG. 14A, in accordance with an example embodiment.

FIG. 14B illustrates another view of the rollers illustrated in FIG. 14A, in accordance with an example embodiment. FIG. 14B depicts a view that shows scrapers 1410 that may be configured to remove debris attached to the electroadhesive surfaces of the rollers 1406A and 1406B. The debris removed can be collected at tray 1412. Flaps 1413A coupled to the roller 1406A, and flaps 1413B coupled to the roller 1406B may function similar to the flaps 714 described with respect to FIG. 7B, for example.

Figure 14C:
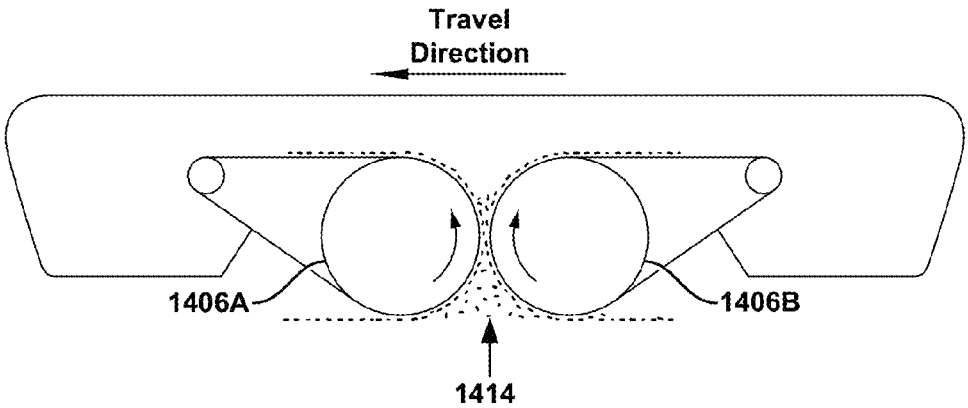
FIG. 14C illustrates an electroadhesive cleaning device having two rollers rotating in opposite directions, in accordance with an example embodiment.

FIG. 14C illustrates an electroadhesive cleaning device having two rollers rotating in opposite directions, in accordance with an example embodiment. FIG. 14C also shows an example direction of travel of the device 1400. In some examples, the two rollers 1406A and 1406B may rotate in the same direction (e.g., clockwise). However, as shown in FIG. 14C, the two rollers 1406A and 1406B may be configured to rotate in opposite directions. In the example shown in FIG. 14C, the front roller 1406A is forward rolling. This roller 1406A may be configured to be used for flattening and breaking up bigger particles of debris being picked up by the electroadhesive cleaning device 1400. The roller 1406B in reverse rolling may then pick up the flattened and/or broken particles. Thus, a dual roller configuration may improve debris pick up performance and may facilitate picking up or removing particles of different sizes from a surface to be cleaned. Also, debris particles 1414 may accumulate in a gap between the rollers 1406A and 1406B. As more dirt particles accumulate, the particles are pushed against the rollers 1406A and 1406B increasing pick up performance.

The foregoing examples illustrated electroadhesive cleaning devices in an arrangement that resembles a household cleaner (e.g., a vacuum cleaner). However, the electroadhesive cleaning device described herein can also be used in alternative arrangements and configurations. For example, electroadhesion cleaning can be applied in an industrial plant to clean objects before processing the objects or before applying a manufacturing process on the objects.

Figure 15:
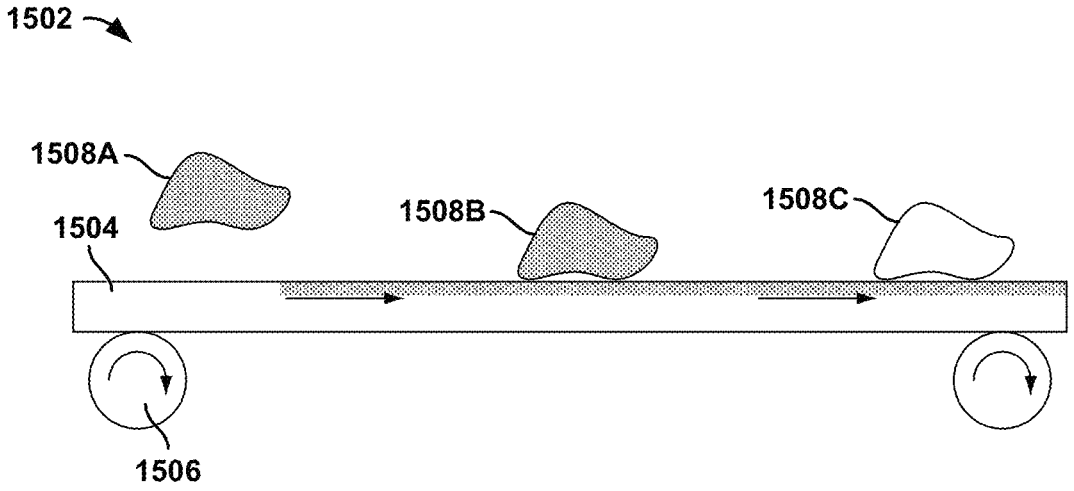
FIG. 15 illustrates in side elevation view a conveyor belt based electroadhesive cleaning system, in accordance with an example embodiment.

FIG. 15 illustrates a separate conveyor belt based electroadhesive cleaning system in side elevation view, in accordance with an example embodiment. This depicted active electroadhesive cleaning system 1502 can include an electroadhesively charged conveyor belt 1504 that processes along a plurality of rollers 1506 or other similar components. This conveyor belt 1504 can include an upper surface that is effectively the electroadhesive surface of the system, as well as a plurality of electrodes (not shown) that can be patterned beneath or otherwise proximate to the belt.

As a given foreign object 1508A that is covered in dirt or dust encounters the electroadhesively charged belt 1504, this foreign object 1508A is cleaned through an electroadhesive process as it jumbles on and travel along the belt. Such a cleaning can be effected by way of, for example, a pulsed electroadhesive force that is applied all along the belt as the foreign object travels therealong. While foreign object 1508A is significantly dirty or dusty when it first encounters the electroadhesively charged conveyor belt 1504 at the left side as shown, some of the dirt or dust is removed from the foreign object 1508B at a partial location along the belt. In some examples, all or a substantial portion of the dirt or dust is removed from foreign object 1508C by the time it reaches the end of travel along belt 1504. Consequently, the belt 1504 itself gets increasingly dirty from the start to the finish of the cleaning process. The reverse process can also be useful in some alternative examples, such as where dust is collected by a belt for purposes of coating an object that travels along it. One example of such a coating process could be to coat glass sheets with powder, such that the glass sheets do not then stick to each other significantly when stacked. In this example, adjusting speed of roller rotation adjusts rate of powder pick up.

Several manufacturing techniques and methods can be used to make the electroadhesive surfaces such as the rollers including the electroadhesive pads described in the foregoing examples. One example method may include blow-molding a cylindrical plastic shape and then pad print (or roller print) electrodes on the outer surface using a conductive ink. Many conductive inks would be appropriate for this purpose as the electrodes carry high voltage and thus are tolerant of resistivity in the electrodes. This manufacturing process may facilitate implementation of "resistive electrodes" (e.g., $10^6$-$10^7$ Ohms/sq) which inherently limit the amount of current that can be passed through the electrodes. Thus, the electroadhesive cleaning device may be safe to touch even if the dielectric coating protecting the electrodes is compromised. The electrodes printed on a roller may have a pattern such as straight stripes (e.g., as shown in FIG. 9A), diagonal stripes (as shown in FIG. 9B), a combination of the two patterns, or any other pattern. Type of pattern of the electrodes printed on the roller and controlling a speed of the roller can be used to cause time-varying as well as space-varying electric field to be presented to the foreign objects or debris on a surface to be cleaned before the debris is adhered to the electroadhesive surface. Such time-varying and space varying electric field may possibly improve debris pick up performance.

Once the electrodes are printed on the surface of the roller, the assembly (of the roller and the electrodes) may be covered with a dielectric coating of the appropriate resistivity. This coating could be made out of polyurethane, for example. The dielectric coating may be configured to be applied such that no air bubbles are in contact with the electrodes so as to avoid electric shorting and a decrease the performance of the electroadhesive roller.

The surface of the dielectric may also be designed and made to have low-friction. In one example, applying the dielectric coating may involve covering the roller with a close-fitting tube of polyurethane designed to heat-shrink tightly around the electroadhesive electrode surface. In another example, the coating process may involve dip-coating in liquid polyurethane and then curing the roller. These examples are for illustration only, and many other manufacturing examples are possible as well.

III. Example Operations

Figure 16:
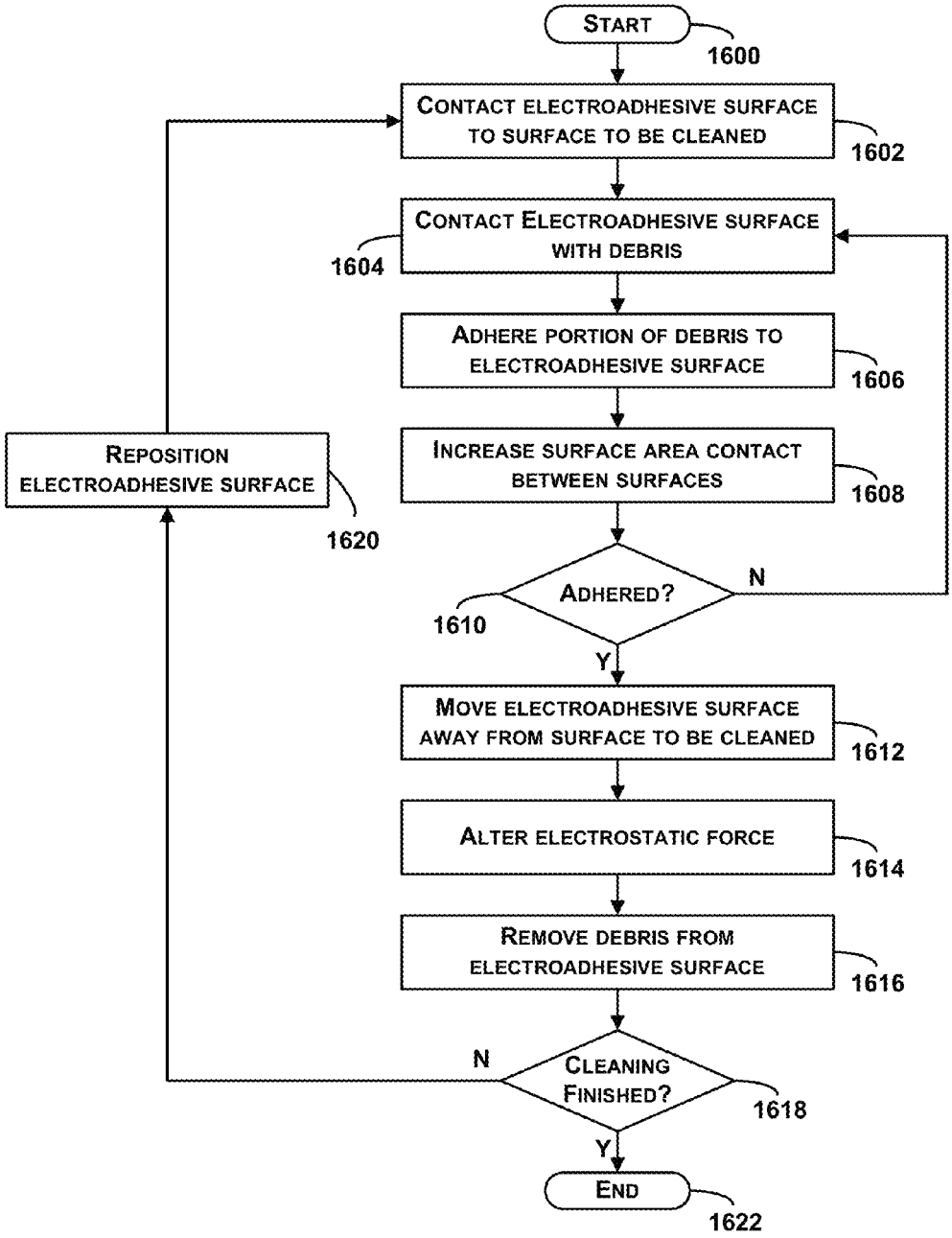
FIG. 16 is a flowchart of a method of cleaning debris from a surface, in accordance with an example embodiment.

Although a wide variety of applications involving cleaning, dusting and otherwise manipulating particulate matter and foreign objects using electroadhesion can be envisioned, one basic method is provided here as an example. FIG. 16 is a flowchart of a method of physically cleaning debris from a surface, in accordance with an example embodiment. In particular, such a method can involve using or operating an active electroadhesive device or system, such as any of the various cleaning pad, track-based or conveyor belt based components, devices and systems described above. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

Beginning with a start step 1600, an electroadhesive surface is brought close to or in contact with a surface to be cleaned at process step 1602. In some examples, electroadhesion voltage may already be applied to electrodes before the electroadhesive surface is brought into contact with the surface to be cleaned. The electroadhesive surface is brought into contact with debris on the surface to be cleaned at step 1604, which cause at least a portion of the debris on the surface to adhere to the electroadhesive surface at process step 1606. At this step also, a voltage may be increased to increase electroadhesion force based on type and quantity of debris, for example. At a following optional process step 1608, the surface area contact can be increased between the electroadhesive surface and each of the plurality of foreign objects as described with respect to FIGS. 4B and 4C. In some examples, a speed of rotation of the electroadhesive pad, roller, or belt can be increased so as to present a cleaner surface of the electroadhesive surface to the debris situated in front of the cleaning device. Increasing rotation speed, while keeping a constant travel speed of the cleaning device across the surface to be cleaned, may allow more debris to be picked up and deposited in a dust tray of the cleaning device, for example.

At a subsequent decision step 1610, an inquiry is made as to whether or not the surface has been adequately cleaned. Detection of such status can be accomplished by way of one or more sensors, for example. In the event that the surface has not been adequately cleaned (i.e., a substantial amount of debris remains on the surface), then the method reverts to process step 1604, where the electrostatic force can be reapplied or increased. In the event that the surface has been cleaned at step 1610, then the method proceeds to process step 1612, where the electroadhesive surface is moved away from the surface to be cleaned.

At the next process step 1614, the electrostatic force can then be altered or modified, such as by adjusting the input voltage. Such altering can be a reduction or complete removal of the electrostatic force, or can even involve a reverse polarity pulse or application of repelling force. At the following process step 1616, the debris can then be removed from the electroadhesive surface such that the electroadhesive surface can then be used to clean other surfaces. At a subsequent decision step 1618, an inquiry is then made as to whether the cleaning is finished. If not, then the method continues to process step 1620, where the electroadhesive surface can be repositioned with respect to the surface to be cleaned. The method then reverts to process step 1602, upon which the entire method is repeated.

In the event that cleaning is finished at step 1618, however, then the method proceeds to finish at and end step 1622. Further steps not depicted can include, for example, sensing the type and/or amount of debris adhered to the electroadhesive surface, and providing added force or steps with respect to removing such items when they are sensed. Other steps can include providing and/or detecting an input with respect to particle sizes in the debris, as well as an actuation within a patterned electrode set that adjusts the size of particles that will be adhered. Other undisclosed process steps may also be included, as may be desired.

Figure 17:
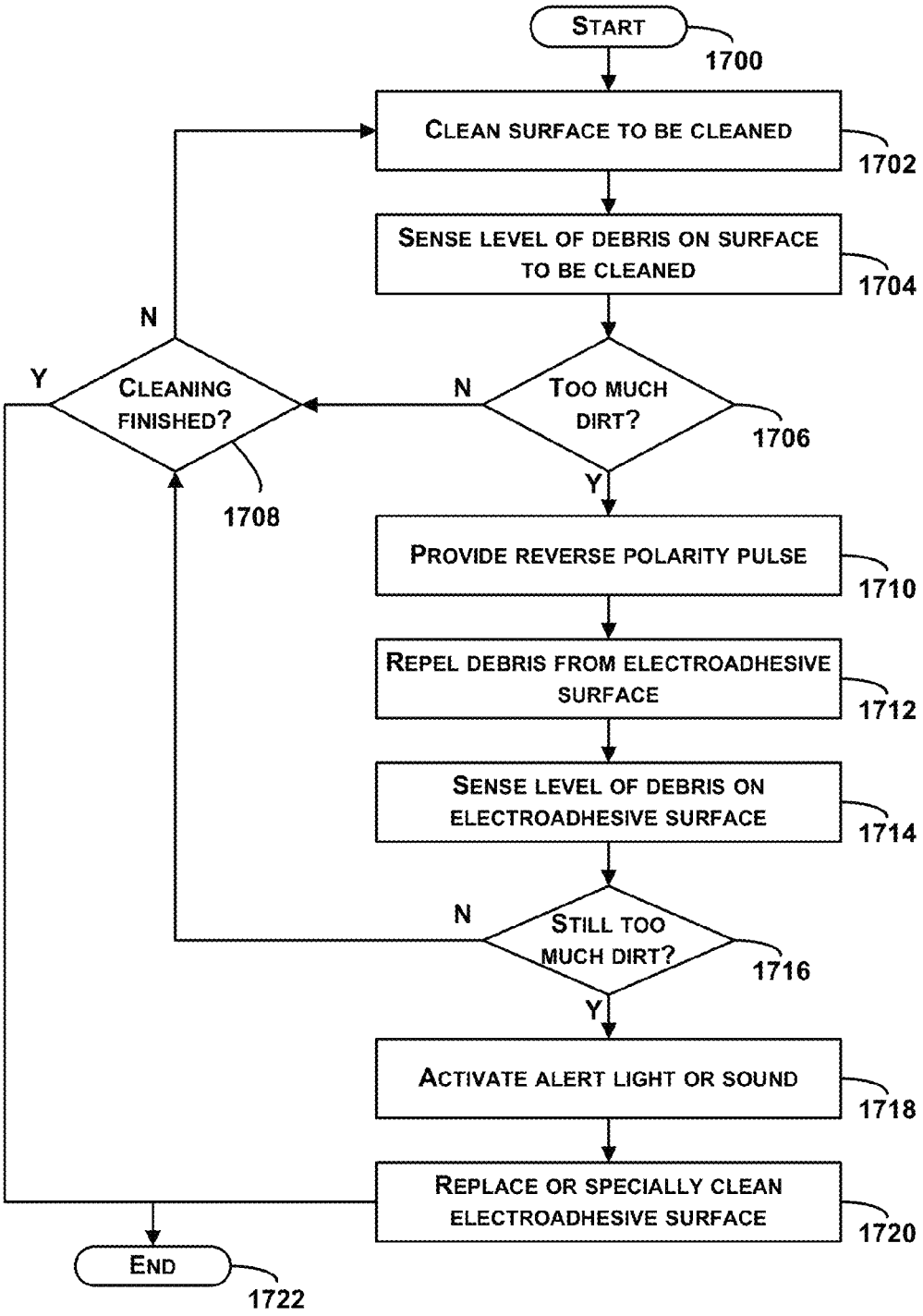
FIG. 17 is a flowchart of a method of electroadhesive cleaning involving reusing an electroadhesive surface, in accordance with an example embodiment.

FIG. 17 is a flowchart of a method of active electroadhesive cleaning involving reusing an electroadhesive surface, in accordance with an example embodiment. The method can involve using or operating an active electroadhesive device or system, such as any of the various cleaning pad, track-based or conveyor belt based components, devices and systems described above. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

Beginning with a start step 1700, a surface is cleaned at process step 1702. Such a cleaning process can be identical or substantially similar to that which is set forth above in FIG. 16, for example. At a subsequent process step 1704, the level or amount of debris on the electroadhesive surface can be sensed. This can be accomplished by way of one or more sensors that measure the capacitance or resistance of the electroadhesive surface at one or more select locations. At a following decision step 1706, an inquiry is made as to whether there is too much debris adhered to the electroadhesive surface. If not, then the method moves on to decision step 1708, where another inquiry is made as to whether or not the cleaning process is finished. If so, then the method ends; however, if not, then the method reverts back to process step 1702 and begins anew.

In the event that there is too much debris detected at decision step 1706, then the method proceeds to process step 1710, where one or more reverse polarity pulses can be provided. At subsequent process step 1712, debris is then repelled from the electroadhesive surface, such as a result from the reverse polarity pulse or pulses. At the following process step 1714, the level amount of debris on the electroadhesive surface is again sensed. At a similar subsequent decision step 1716, an inquiry is made as to whether there is still too much debris remaining on the electroadhesive surface. If not, then the method can proceed to decision step 1708, with the process from that point already being provided above.

If it is determined at step 1716 that there is still too much debris on the electroadhesive surface, however, then a visible or audio alert or alarm is provided at process step 1718, such as by a light or sound to the user. The electroadhesive surface can then be specially cleaned or even replaced at process step 1720, upon which the method then ends at step 1722.

Figure 18:
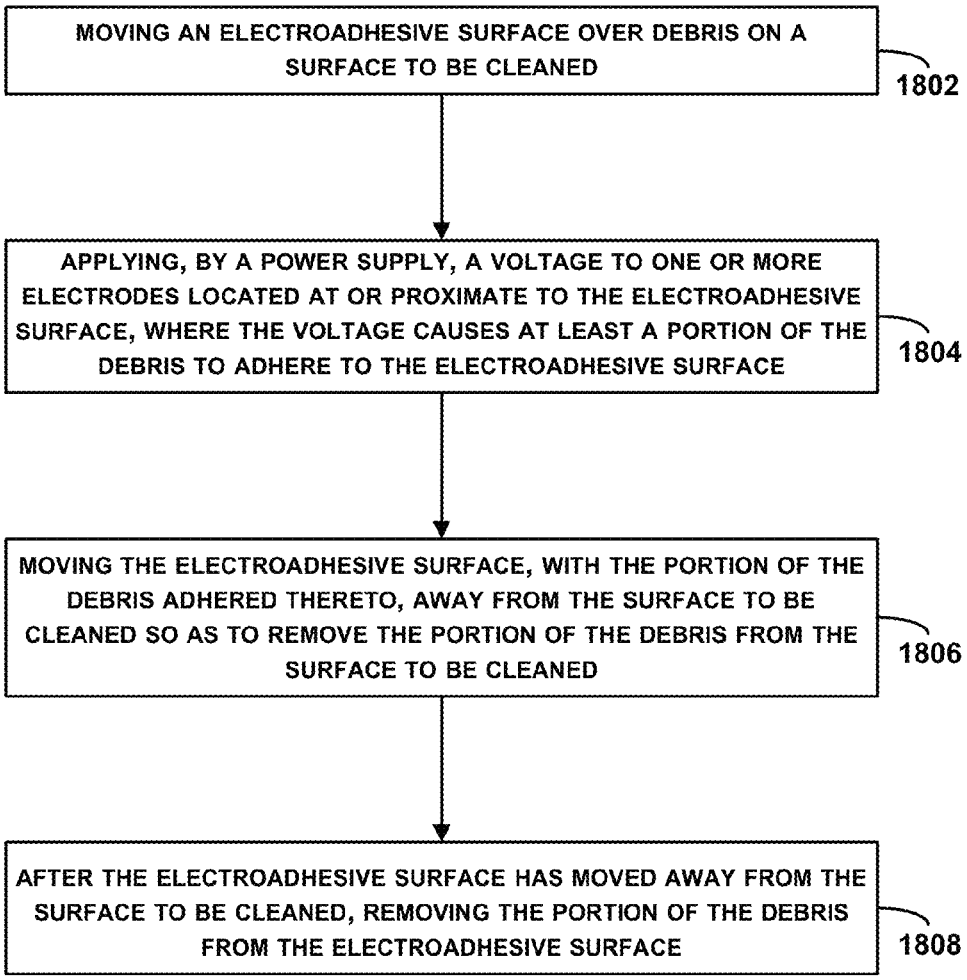
FIG. 18 is a flowchart of a method of electroadhesive cleaning of a surface having debris thereon, in accordance with an example embodiment.

FIG. 18 is a flowchart of a method of electroadhesive cleaning of a surface having debris thereon, in accordance with an example embodiment. The method can involve using or operating an active electroadhesive device or system, such as any of the various cleaning pad, track-based or conveyor belt based components, devices and systems described above. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 1802, the method includes a moving an electroadhesive surface over debris on a surface to be cleaned. An electroadhesive cleaning device such as any of the devices described in FIGS. 10A-10I, 11A-11C, 12, 13, and 14A-14C may include an electroadhesive surface. The electroadhesive surface may include the surface of a roller as described in FIG. 11A, or arrangements 1 and 2 in FIG. 12, for example. In other examples, the surface may include the surface of an electroadhesive pad such as the electroadhesive pad 1206 in FIG. 12. For instance, referring to FIG. 10D, the electroadhesive cleaning device 1000 may be configured to move across the surface 1018 to be cleaned from debris 1022.

At block 1804, the method includes applying, by a power supply, a voltage to one or more electrodes located at or proximate to the electroadhesive surface, where the voltage causes at least a portion of the debris to adhere to the electroadhesive surface. The voltage can be applied by the power supply without an external input; however, in other examples, the voltage level may be based on an external input.

Figure 19:
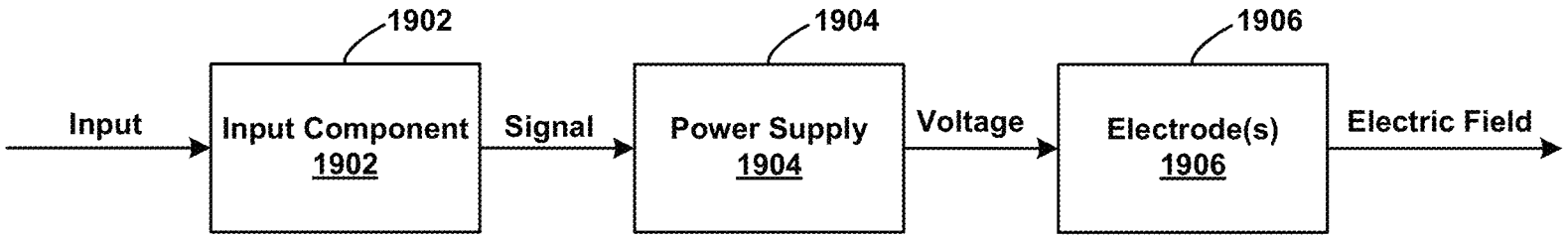
FIG. 19 is a block diagram illustrating providing a voltage by a power supply to electrodes based on a user-input, in accordance with an example embodiment.

FIG. 19 is a block diagram illustrating providing a voltage by a power supply to electrodes based on a user-input, in accordance with an example embodiment. FIG. 19 depicts an input provided to an input component 1902. As an example for illustration, the electroadhesive device may, for example, include a handle such as the handle 1004 shown in FIG. 4D. The handle may include an input component such as a button, dial, knob, etc. A user may provide an input to the input component 1902 (e.g., a user pressing on a button or dialing a level of voltage). The input component module 1902 may provide a signal, based on the input, to a power supply 1904. The power supply 1904 may, based on such signal, apply a voltage to electrode(s) 1906. The electrode(s) 1906 may be coupled to the electroadhesive surface. As a result of the voltage applied thereto, the electrode(s) produce an electric field effective to produce electroadhesion forces causing debris on the surface to be cleaned to adhere to the electroadhesive surface. The voltage applied by the power supply 1904 can be controlled or modified (e.g., based on the input to the input component 1902) such that a size of the debris to be picked up from the surface to be cleaned can be designated based on the level of voltage. An amount of debris on the surface to be cleaned may be indicated by the user. Based on the indicated amount, the speed of rotation of a roller or electroadhesive belt of the cleaning device can be modified to optimize pick up rate of the debris, for example.

Components of the block diagram in FIG. 19 may be configured to work in an interconnected fashion with each other and/or with other components coupled to respective systems. One or more of the described functions, components, or blocks of the block diagram in FIG. 19 may be divided up into additional functional or physical components, or combined into fewer functional or physical components. In some further examples, additional functional and/or physical components may be added to the blocks shown in FIG. 19.

Returning to FIG. 18, at block 1806, the method includes, moving the electroadhesive surface, with the portion of the debris adhered thereto, away from the surface to be cleaned so as to remove the portion of the debris from the surface to be cleaned. The electroadhesive surface can include the surface of a roller and/or a belt, for example. As the electroadhesive cleaning device moves across the surface to be cleaned, the roller and/or belt rotate, while the debris is adhered thereto. The roller and/or belt rotate away, and thus remove the debris, from the surface being cleaned.

At block 1808, the method includes, after the electroadhesive surface has moved away from the surface to be cleaned, removing the portion of the debris from the electroadhesive surface. The electroadhesive device may include a scraper and/or a brush, or any other cleaning component (e.g., a sponge) that may be configured to remove the portion of the debris attached to the electroadhesive surface. The scraper may, for example, be similar to the scraper 1114 shown in FIG. 11B to the scraper 1032 shown in FIG. 10F, and the brush may be similar to the brush 1034 depicted in FIG. 10F. For instance, as the electroadhesive surface moves away from the surface to be cleaned, the removal component (e.g., scraper, brush, sponge, etc.) may be configured to remove the debris attached to the electroadhesive surface.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims, along with the full scope of equivalents to which such claims are entitled. It is also to be understood that the terminology used herein is for the purpose of describing particular embodiments only, and is not intended to be limiting.

What is claimed is:

1. A device comprising:

at least one electroadhesive surface positioned at or proximate to one or more electrodes and configured to interact with debris on a surface to be cleaned, wherein the at least one electroadhesive surface is separate from, and configured to move relative to, the one or more electrodes; and a power supply configured to apply an input voltage to the one or more electrodes to thereby cause at least a portion of the debris to adhere to the electroadhesive surface, wherein the at least one electroadhesive surface is configured to move, with the portion of the debris adhered thereto, away from the surface to be cleaned so as to remove the portion of the debris from the surface to be cleaned.

2. The device of claim 1, wherein the at least one electroadhesive surface comprises a plurality of cilia to facilitate adhesion of the portion of the debris thereagainst.

3. The device of claim 1, wherein the at least one electroadhesive surface comprises a compliant surface configured to comply with a shape of the surface to be cleaned.

4. The device of claim 1, further comprising:

one or more rollers coupled to the at least one electroadhesive surface such that the at least one electroadhesive surface rotates, with the one or more rollers, away from the surface to be cleaned.

5. The device of claim 4, wherein at least one of the one or more rollers is configured to rotate in a same direction as a respective direction of motion of the device on the surface to be cleaned.

6. The device of claim 4, wherein at least one of the one or more rollers is configured to rotate in a direction opposite to a respective direction of motion of the device.

7. The device of claim 4, wherein the at least one electroadhesive surface is configured as a continuous track that moves with respect to a rotational motion of the one or more rollers.

8. The device of claim 4, further comprising:

a scraper proximate to the at least one electroadhesive surface coupled to the one or more rollers, wherein the scraper is configured to, as the one or more rollers rotate, remove the portion of the debris adhered against the at least one electroadhesive surface.

9. The device of claim 8, further comprising:

a tray configured to collect the portion of the debris removed by the scraper.

10. The device of claim 8, further comprising:

a spring coupled to the scraper and configured to push the scraper against the at least one electroadhesive surface.

11. The device of claim 1, wherein the one or more electrodes comprise a plurality of oppositely chargeable electrodes arranged in a given pattern.

12. The device of claim 11, wherein the pattern comprises an interdigitated pattern having a plurality of differing pitches.

13. The device of claim 12, wherein each of the plurality of differing pitches is configured to cause respective debris of a correspondingly different size to adhere to the at least one electroadhesive surface.

14. The device of claim 1, further comprising:

an ion charge sprayer positioned proximate to the at least one electroadhesive surface and configured to spray a plurality of ionic charges onto the debris, wherein electroadhesion of the portion of the debris results at least partially from the presence of the ionic charges sprayed on the debris.

15. The device of claim 14, wherein the one or more electrodes include exactly one electrode, wherein the exactly one electrode is configured to carry a charge of an opposite polarity from the plurality of ionic charges.

16. The device of claim 1, wherein the one or more electrodes are further configured to produce one or more reverse polarity pulses, wherein the one or more reverse polarity pulses result in respective repellant forces effective to repel the portion of the debris away from the electroadhesive surface.

17. The device of claim 1, further comprising:

one or more sensors coupled to the at least one electroadhesive surface and configured to detect an amount of debris adhered to the at least one electroadhesive surface.

18. A system comprising:

an electroadhesive surface positioned at or proximate to one or more electrodes and configured to interact with debris on a surface to be cleaned, wherein the electroadhesive surface is separate from, and configured to move relative to, the one or more electrodes; and a power supply configured to apply an input voltage to the one or more electrodes to thereby cause at least a portion of the debris to adhere to the electroadhesive surface, wherein the electroadhesive surface is configured to move, with the portion of the debris adhered thereto, away from the surface to be cleaned so as to remove the portion of the debris from the surface to be cleaned; and a removal component configured to facilitate removal of the portion of the debris adhered to the electroadhesive surface after the portion has been removed from the surface to be cleaned.

19. The system of claim 18, wherein a level of the input voltage corresponds to a size of debris to be removed from the surface to be cleaned.

20. The system of claim 18, further comprising:

one or more rollers coupled to the electroadhesive surface such that the electroadhesive surface rotates, with the one or more rollers, away from the surface to be cleaned.

21. A method comprising:

moving an electroadhesive surface over debris on a surface to be cleaned;

applying, by a power supply, a voltage to one or more electrodes located at or proximate to the electroadhesive surface, wherein the electroadhesive surface is separate from, and configured to move relative to, the one or more electrodes, wherein the voltage causes at least a portion of the debris to adhere to the electroadhesive surface;

moving the electroadhesive surface, with the portion of the debris adhered thereto, away from the surface to be cleaned so as to remove the portion of the debris from the surface to be cleaned; and after the electroadhesive surface has moved away from the surface to be cleaned, removing the portion of the debris from the electroadhesive surface.

22. The method of claim 21, wherein the surface to be cleaned is a floor.

23. The method of claim 21, wherein the debris comprises particulate matter.

* * * * *